US009476156B2

(12) United States Patent
Jung et al.

(10) Patent No.: US 9,476,156 B2
(45) Date of Patent: Oct. 25, 2016

(54) PORTABLE TERMINAL AND CONTROL METHOD OF CLOTHES TREATMENT APPARATUS USING THE SAME

(71) Applicant: LG ELECTRONICS INC., Seoul (KR)

(72) Inventors: Mijin Jung, Seoul (KR); Kyounghoon Ham, Seoul (KR); Mikyung Ha, Seoul (KR); Nayoung Youk, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 967 days.

(21) Appl. No.: 13/734,493

(22) Filed: Jan. 4, 2013

(65) Prior Publication Data

US 2014/0018962 A1 Jan. 16, 2014

Related U.S. Application Data

(60) Provisional application No. 61/583,627, filed on Jan. 6, 2012.

(51) Int. Cl.
*D06F 39/00* (2006.01)
*D06F 33/02* (2006.01)

(52) U.S. Cl.
CPC ..... *D06F 39/005* (2013.01); *D06F 33/02* (2013.01); *D06F 2202/10* (2013.01); *D06F 2204/10* (2013.01)

(58) Field of Classification Search
CPC ..... D06F 39/00
USPC ..... 700/275; 139/396
See application file for complete search history.

(56) References Cited

U.S. PATENT DOCUMENTS

2003/0084954 A1* 5/2003 Hamby ..... D02G 3/346 139/396

FOREIGN PATENT DOCUMENTS

KR 2010115295 A * 10/2010

OTHER PUBLICATIONS

Kim Y S, Oct. 27, 2010. (Translation) "Method for obtaining information about laundry process in washing machine, involves capturing laundry process picture via camera, and searching identifying information in database to decide whether laundry is to be placed in machine."*

* cited by examiner

*Primary Examiner* — Tejal Gami
(74) *Attorney, Agent, or Firm* — Dentons US LLP

(57) ABSTRACT

Disclosed is a portable terminal including a clothes information input unit, to which at least one of fiber blending ratio information of clothes and laundry care symbol information is input, a display unit to display the information input via the clothes information input unit, a storage unit in which a plurality of clothes treatment methods is stored, the clothes treatment methods being classified based on the at least one of the fiber blending ratio information of clothes and information on a handling method of clothes, and a controller that selects at least one of the clothes treatment methods stored in the storage unit based on the information input via the clothes information input unit, and allows the selected clothes treatment method to be displayed on the display unit.

16 Claims, 24 Drawing Sheets

(i)

(g) (h)

PORTABLE TERMINAL AND CONTROL METHOD OF CLOTHES TREATMENT APPARATUS USING THE SAME

Pursuant to 35 U.S.C. §119(e), this application claims the benefit of U.S. Provisional Patent Application No. 61/583,627, filed on Jan. 6, 2012 which is hereby incorporated by reference as if fully set forth herein.

BACKGROUND OF THE INVENTION

1. Field of the Invention

The present invention relates to a portable terminal and a control method of a clothes treatment apparatus using the same.

2. Discussion of the Related Art

Clothes treatment apparatuses include a washing machine to wash clothes, a drying machine to dry clothes, and a combined drying and washing machine to wash and dry clothes.

A conventional clothes treatment apparatus for washing of clothes includes a tub in which wash water is stored, a drum rotatably disposed within the tub, in which laundry is stored, a drive unit to rotate the drum, and water supply and drainage units for supply of wash water into the tub and for drainage of wash water from the tub respectively.

A conventional clothes treatment apparatus for drying of clothes includes a drum in which clothes are received, a drive unit to rotate the drum, and a hot air supply unit to supply hot air into the drum. Also, a conventional clothes treatment apparatus that can perform both drying and washing of clothes includes a tub, a drum, a drive unit, water supply and drainage units, and a hot air supply unit.

The above described conventional clothes treatment apparatuses are designed in such a way that a user directly selects a clothes treatment method (a washing course or drying course) and inputs the selected method to the clothes treatment apparatus when attempting to wash or dry clothes.

SUMMARY OF THE INVENTION

Accordingly, the present invention is directed to a portable terminal and a control method of a clothes treatment apparatus using the same that substantially obviate one or more problems due to limitations and disadvantages of the related art.

An object of the present invention is to provide a portable terminal that acquires information from a laundry tag attached to clothes and recommends a clothes treatment method to a user, and a control method of a clothes treatment apparatus using the same.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a portable terminal includes a clothes information input unit, to which at least one of fiber blending ratio information of clothes and laundry care symbol information representing a handling method of clothes is input, a display unit to display the information input via the clothes information input unit, a storage unit in which a plurality of clothes treatment methods is stored, the clothes treatment methods being classified based on the at least one of the fiber blending ratio information of clothes and information on the handling method of clothes, and a controller that selects at least one of the clothes treatment methods stored in the storage unit based on the information input via the clothes information input unit, and allows the selected clothes treatment method to be displayed on the display unit.

In accordance with another aspect of the present invention, a portable terminal includes a display unit having a display area where at least one of fiber blending ratio information of clothes and laundry care symbol information representing a handling method of clothes is displayed, and an input unit to enable selection of the information displayed in the display area, a storage unit in which a plurality of clothes treatment methods is stored, the clothes treatment methods being classified based on the at least one of the fiber blending ratio information of clothes and information on the handling method of clothes, and a controller that selects at least one of the clothes treatment methods stored in the storage unit based on the information input via the display unit, and allows the selected clothes treatment method to be displayed on the display unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, exemplary embodiments of the present invention will be described in detail with reference to the accompanying drawings.

So long as being not specially defined, all terms in the context of describing the invention may be commonly understood by those skilled in the art to have the same meaning as the general meaning, or may be dedicatedly defined in the specification if having a specific meaning conflicting with the general meaning thereof.

Meanwhile, a configuration or a control method that will be described hereinafter is intended to explain the embodiments of the present invention and is not intended to limit the scope of the present invention thereto. The same reference numbers will be used throughout the drawings to refer to the same or like parts.

Figure 1:
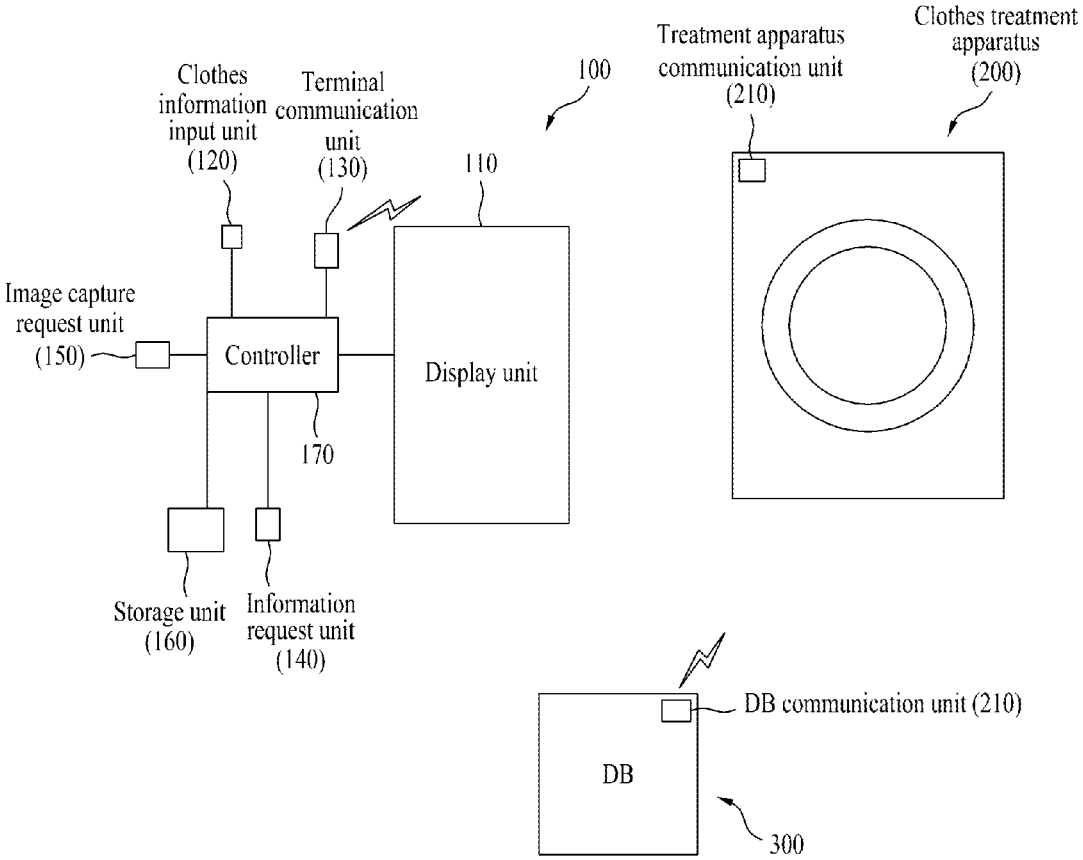
FIG. 1 is a view illustrating a system including a portable terminal, a clothes treatment apparatus, and a database.

FIG. 1 is a view illustrating a system including a portable terminal, and a clothes treatment apparatus and a database, both of which can communicate with the portable terminal.

The portable terminal of the present invention, designated by reference numeral 100, is usable with a system including a clothes treatment apparatus 200 and a database 300. The portable terminal 100 functions as a control device as well as a monitoring device for the clothes treatment apparatus 200 and the database 300.

The clothes treatment apparatus 200 may be any one of a washing machine, a drying machine, and a combined drying and washing machine. The clothes treatment apparatus 200 may perform data communication with the portable terminal 100 and the database 300.

The database 300 may perform data communication with each of the portable terminal 100 and the clothes treatment apparatus 200. Information on various clothes treatment methods including washing or drying is stored in the database 300.

The portable terminal 100 includes a clothes information input unit 120 to which clothes information is input, a display unit 110 to display the information input via the clothes information input unit 120, and a controller 170 to control the clothes information input unit 120 and the display unit 110.

Although one example of the portable terminal 100 may be a portable phone, the present invention is not necessary limited thereto.

The clothes information input unit 120 serves to input a handling method of clothes acquired from a laundry tag attached to clothes or a fiber blending ratio of clothes to the portable terminal 100.

The laundry tag is a tag attached to clothes, on which at least one of laundry care symbols or the fiber blending ratio of clothes is marked. The fiber blending ratio of clothes refers to a mark representing a constitution ratio of different fibers constituting clothes.

Meanwhile, the clothes information input unit 120, as illustrated in FIG. 1, may take the form of hardware, such as a camera.

The camera may be utilized as a device for input of other information, in addition to the clothes information input unit 120. That is, the camera may be utilized as a device for input or exchange of information by capturing an image of an object other than the laundry tag. Other examples of the input or exchange device may include a device for input of a product barcode and a device for initiating a video call with another portable terminal.

The display unit 110 may be a touch panel in which a display device and an input device are integrated. Thus, a user can identify information and input control instructions via the display unit 110.

The portable terminal 100 may further include a storage unit 160 in which information input via the clothes information input unit 120 is stored. The storage unit 160 may be provided as an additional storage unit separate from the controller 170, or may be integrally formed with the controller 170.

The storage unit 160 may store a plurality of clothes treatment methods classified based on at least one of the blending radio of clothes, a handling method of clothes, and color information of clothes. In this case, the information stored in the storage unit 160 may be periodically updated by the database 300.

Additionally, the portable terminal 100 may include a terminal communication unit 130 for data exchange with the clothes treatment apparatus 200 and the database 300. Accordingly, clothes information input via the clothes information input unit 120 or information stored in the storage unit 160 may be transmitted to the clothes treatment apparatus 200 or the database 300 via the terminal communication unit 130.

The controller 170 may receive information provided by the database 300 or the clothes treatment apparatus 200 via the terminal communication unit 130.

Assuming that the clothes information input unit 120 is a camera, the portable terminal 100 of the present invention may further include an image capture request unit 150 to actuate the camera for image capture.

The image capture request unit 150 may take the form of a physical button provided at a housing (not shown) defining an external appearance of the portable terminal 100, or may take the form of an image capture request area (software key) that is displayed on the display unit 110 to generate an actuation signal of the camera in response to user touch.

The portable terminal 100 may further include an information request unit 140 to request that information stored in the storage unit 160 be displayed on the display unit 110.

Similarly, the information request unit 140 may take the form of a physical button provided at the housing (not shown) of the portable terminal 100, or may take the form of a software key.

The database 300 stores a plurality of clothes treatment methods classified based on at least one of the blending radio of clothes, a handling method of clothes, and color information of clothes.

The database 300 may be managed by a manufacturer of the clothes treatment apparatus 200, for example. The database 300 may transmit a new clothes treatment method to the storage unit 160 and the clothes treatment apparatus 200 via a DB communication unit 310.

The clothes treatment methods may be data for control of the clothes treatment apparatus 200, and examples thereof may include washing course data, drying course data, and washing and drying course data.

The clothes treatment apparatus 200 may include a tub in which wash water is stored, a drum rotatably disposed within the tub, a drive unit to rotate the drum, and water supply and drainage units for supply of wash water into the tub and drainage of wash water from the tub respectively, and a hot air supply unit to supply hot air into the tub.

In this case, one example of data for control of the clothes treatment apparatus 200 may include control data of the drive unit for control of a rotating direction, revolutions per minute, and rotating time with respect to the drum.

Another example of data for control of the clothes treatment apparatus 200 may include control data of the water supply and drainage units for control of the quantity of wash water to be supplied into the tub, or for control of water supply or drainage time.

A further example of data for control of the clothes treatment apparatus 200 may include control data of the hot air supply unit for control of a total operation duration and an operation beginning time of the hot air supply unit, and for control of the temperature of hot air supplied by the hot air supply unit.

It is to be noted that the above description related to data for control of the clothes treatment apparatus 200 is based on the assumption that the clothes treatment apparatus 200 is a combined washing and drying machine.

Alternatively, assuming that the clothes treatment apparatus 200 has only one purpose of drying, data (clothes treatment methods) for control of the clothes treatment apparatus 200 may be control data of the drive unit and control data of the hot air supply unit.

Alternatively, assuming that the clothes treatment apparatus 200 has only one purpose of washing, data for control of that clothes treatment apparatus 200 may be control data of the drive unit and control data of the water supply and drainage units.

The database 300 and the clothes treatment apparatus 200 may respectively include the DB communication unit 310 and a treatment apparatus communication unit 210 for data exchange with the portable terminal 100.

Also, data exchange between the database 300 and the clothes treatment apparatus 200 may be possible via the DB communication unit 310 and the treatment apparatus communication unit 210.

The controller 170 included in the portable terminal 100 of the present invention has a feature of selecting at least one of the clothes treatment methods stored in the storage unit 160 based on information input via the clothes information input unit 120 and allowing the selected method to be displayed on the display unit 110.

Figure 2A:
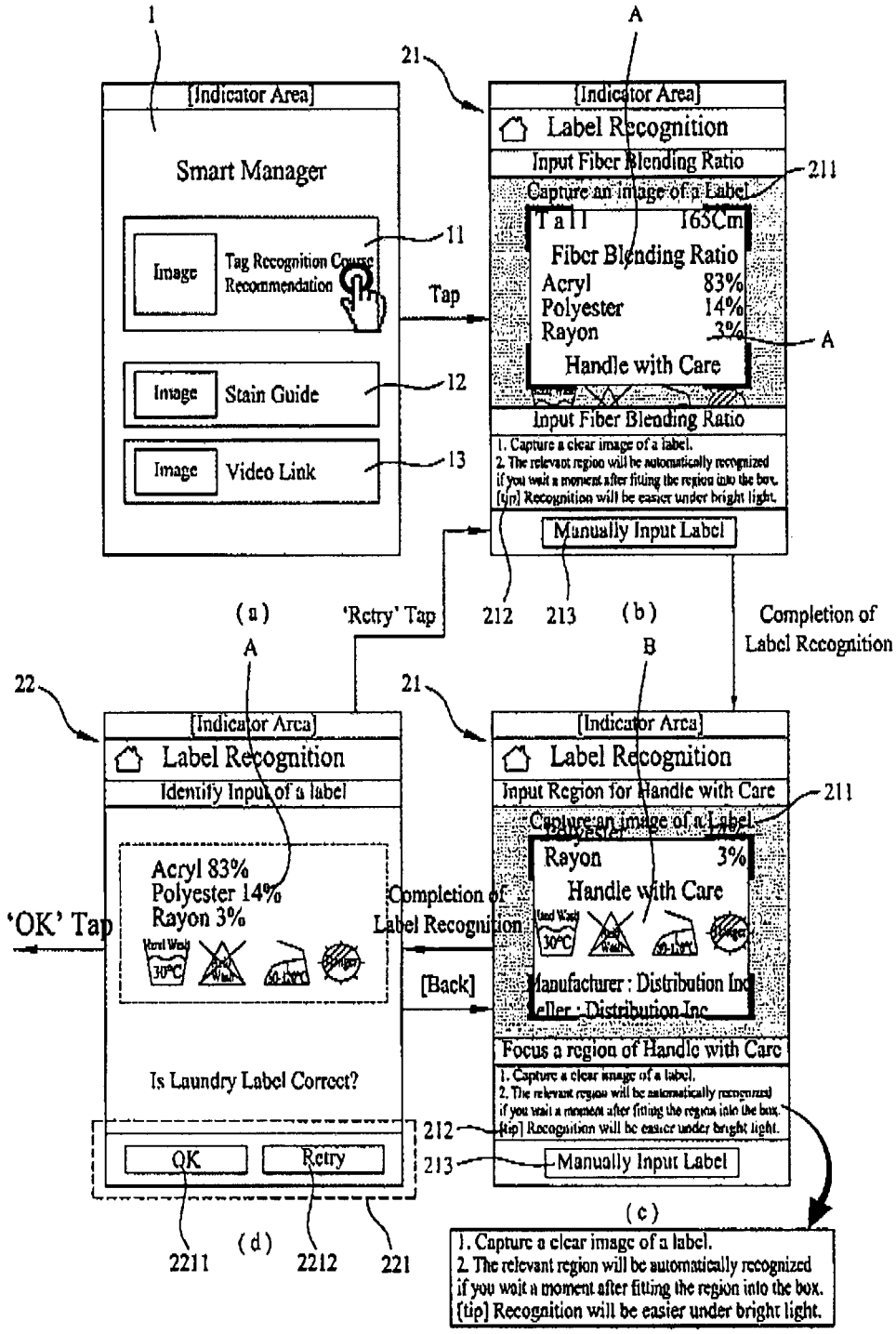
FIGS. 2 and 3 are views illustrating procedures of recommending a clothes treatment method via image capture of a laundry tag, and of transmitting the recommended clothes treatment method to the clothes treatment apparatus.
Figure 2B:
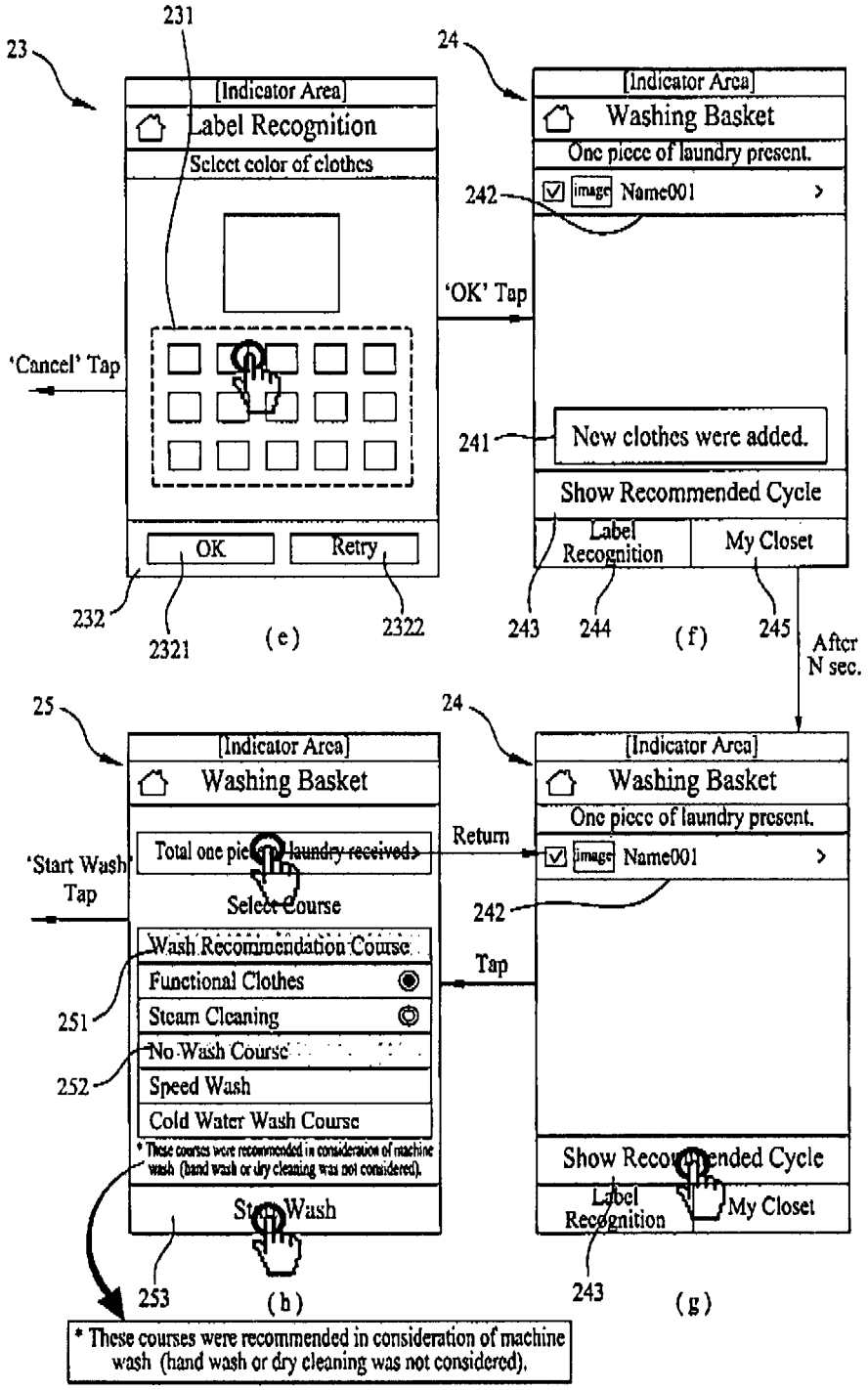
Figure 2C:
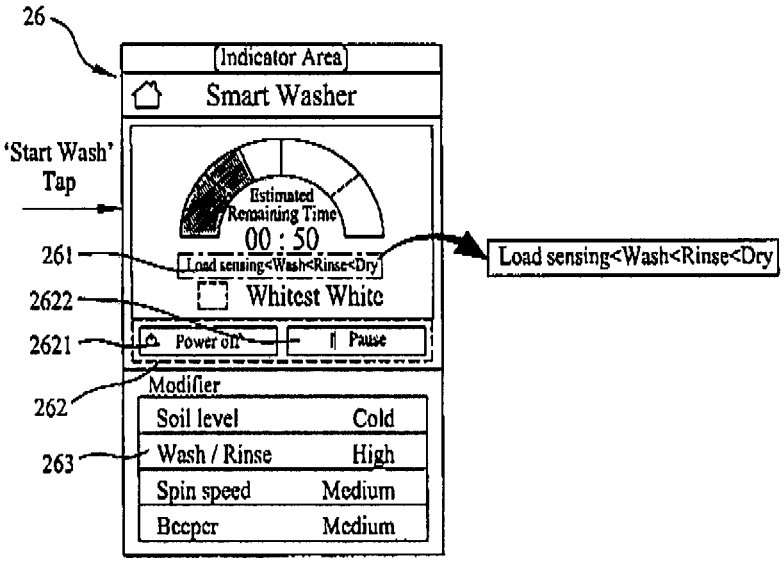

As illustrated in FIG. 2(*a*), the display unit 110 included in the portable terminal 100 of the present invention displays a main window 1 containing at least one or more selective areas 11, 12 and 13.

The selective areas displayed in the main window 1 include a tag recognition course recommendation selective area 11 to input clothes information to the portable terminal 100 via image capture of a laundry tag.

If the user touches the tag recognition course recommendation selective area 11 of the main window 1, the display unit 110 displays an image capture guidance window 21.

The tag recognition course recommendation selective area 11 is an area to request that the portable terminal 100 recommend a clothes treatment method via image capture of a laundry tag attached to clothes.

In general, at least one of laundry care symbols that symbolically represent a handling method of clothes and the fiber blending ratio of clothes are printed on the laundry tag.

Accordingly, if the controller 170 acquires information related to the fiber blending ratio of clothes or a handling method of clothes from an image of the laundry tag captured by the camera, and the storage unit 160 transmits an appropriate clothes treatment method based on the fiber blending ratio of clothes or the handling method of clothes to the controller 170, the user can identify an appropriate washing or drying course for the corresponding clothes via the display unit 110.

For convenience, the following description is based on the case in which both the fiber blending ratio of clothes and laundry care symbols are marked on the laundry tag.

If the user selects the tag recognition course recommendation selective area 11 from the main window 1, the display unit 110 displays the image capture guidance window 21.

The image capture guidance window 21 contains a guide area 211, which represents a permitted image capture range of a laundry tag when capturing an image of the laundry tag via the camera.

Accordingly, the user can capture an image of information printed on a laundry tag by adjusting a distance between the camera and the laundry tag until a desired region of the laundry tag is located within the guide area 211, and then pushing the image capture request unit 150.

Additionally, to notify the user of the above described context, the image capture guidance window 21 may further contain an instruction area 212 to guide an image capture method of the laundry tag via the camera.

FIG. 2(*b*) illustrates image capture of the fiber blending ratio of clothes A via the image capture guidance window 21, and FIG. 2(*c*) illustrates image capture of laundry care symbols B via the image capture guidance window 21.

After image capture of information printed on the laundry tag is completed, the display unit 110 displays a captured result display window 22 as illustrated in FIG. 2(*d*).

Assuming that images of both the fiber blending ratio of clothes A and the laundry care symbols B are captured, the captured result display window 22 displays both the captured images of the fiber blending ratio A and the laundry care symbols B. Then, a result identification window 221 is displayed, to allow the user to identify whether or not the captured images are desired images to be input to the portable terminal 100.

The result identification window 221 may be a pop-up window, or may be an "always displayed" window on a partial region of the captured result display window 22.

Meanwhile, if the user touches an identification area 2211 via the result identification window 221, the display unit 110 displays an additional information input window 23. On the other hand, if the user touches a re-capturing area 2212 via the result identification window 221, the display unit 110 displays the image capture guidance window 21.

The additional information input window 23 is used to guide input of information required for washing or drying of clothes, rather than the fiber blending ratio of clothes and laundry care symbols. FIG. 2(*e*) illustrates one example of the additional information input window 23 to request input of color information of clothes.

The additional information input window 23 displays a color selection area 231 in which a plurality of colors is displayed, and a selection identification area 232 to allow the user to identify whether or not a selected color is a desired color.

Since the display unit 110 according to the present invention is a touch panel, the user can select the color of the clothes by touching a displayed region of a desired color of the plurality of colors displayed in the color selection area 231 with his/her finger. Additionally, the user can perform color re-selection 2322 and color information storage 2321 via the selection identification area 232.

After input of additional information on colors of clothes via the additional information input unit 23 is completed, the controller 170 stores the fiber blending ratio of clothes, a handling method of clothes and color information of clothes, in the storage unit 160, and controls the display unit 110 so as to display a basket display window 24 as illustrated in FIG. 2(*f*).

Meanwhile, if storage of information is requested via the selection identification area 232, the display unit 110 may display a storage completion notification window 241.

The storage completion notification window 241 is displayed within the basket display window 24, and takes the form of a pop-up window that exists only for a predetermined time. The storage completion notification window 241 serves to notify the user that information related to clothes is stored in the storage unit 160.

The basket display window 24 may further contain a laundry display area 242, a course recommendation request area 243, and an additional image capture request area 244.

The laundry display area 242 is an area to display information (name of clothes, etc.) on clothes as a subject to be washed or dried, which is input via the clothes information input unit 120, such as the camera.

If the user pushes the laundry display area 242 of the basket display window 24, the display unit 110 displays the fiber blending ratio of clothes, a handling method of clothes, color information of clothes, etc. A detailed description thereof will follow.

The additional image capture request area 244 is an area to request an image re-capture of the laundry tag. If the user pushes the additional image capture request area 244, the display unit 110 will display the image capture guidance window 21.

The course recommendation request area 243 is an area to request the controller 170 to control the display unit 110 so as to display an appropriate clothes treatment method based on the fiber blending ratio of clothes and a handling method of clothes input via the camera and other information input via the additional information input window 23.

The storage unit 160 stores a plurality of clothes treatment methods classified based on the fiber blending ratio of clothes and a handling method of clothes, color information of clothes, etc. Accordingly, if the user pushes the course recommendation request area 243, the controller 170 controls the display unit 110 so as to display a clothes treatment method suitable for clothes having information input via the camera and the additional information input window 23 among the plurality of clothes treatment methods stored in the storage unit 160.

That is, if the user pushes the course recommendation request area 243, the display unit 110 displays a recommended course display window 25 as illustrated in FIGS. 2(*g*) and 2(*h*). The recommended course display window 25 may display not only an appropriate clothes treatment method (a recommended course display area 251), but also an inappropriate clothes treatment method (a non-recommended course display area 252).

The recommended course display window 25 may further contain a control signal transmission area 253 that requests transmission of a clothes treatment method selected by the user to the clothes treatment apparatus 200 and commands the clothes treatment apparatus 200 to execute the clothes treatment method.

Accordingly, the user can select a clothes treatment method (a recommended course) suitable for particular clothes via the recommended course display area 251, and can command transmission of the recommended course to the clothes treatment apparatus 200 and execution of the recommended course via the control signal transmission area 253.

If the user pushes the control signal transmission area 253, the display unit 110 displays an operating state display window 26. The operating state display window 26 may contain a state display area 261, an operating signal transmission area 262, and a course information display area 263.

The state display area 261 is an area to display a name, a remaining time, etc. of the clothes treatment method being executed by the clothes treatment apparatus 200. The course information display area 263 is an area to display detailed information on the recommended course (soil level, intensity of wash and rinse, spin speed, etc.).

The operating signal transmission area 262 is an area to transmit a signal for control of the clothes treatment apparatus 200. The operating signal transmission area 262 may include a power off area 2621 to stop supply of power to the clothes treatment apparatus 200, and a pause area 2622 to temporarily stop operation of the clothes treatment apparatus 200.

Figure 3A:
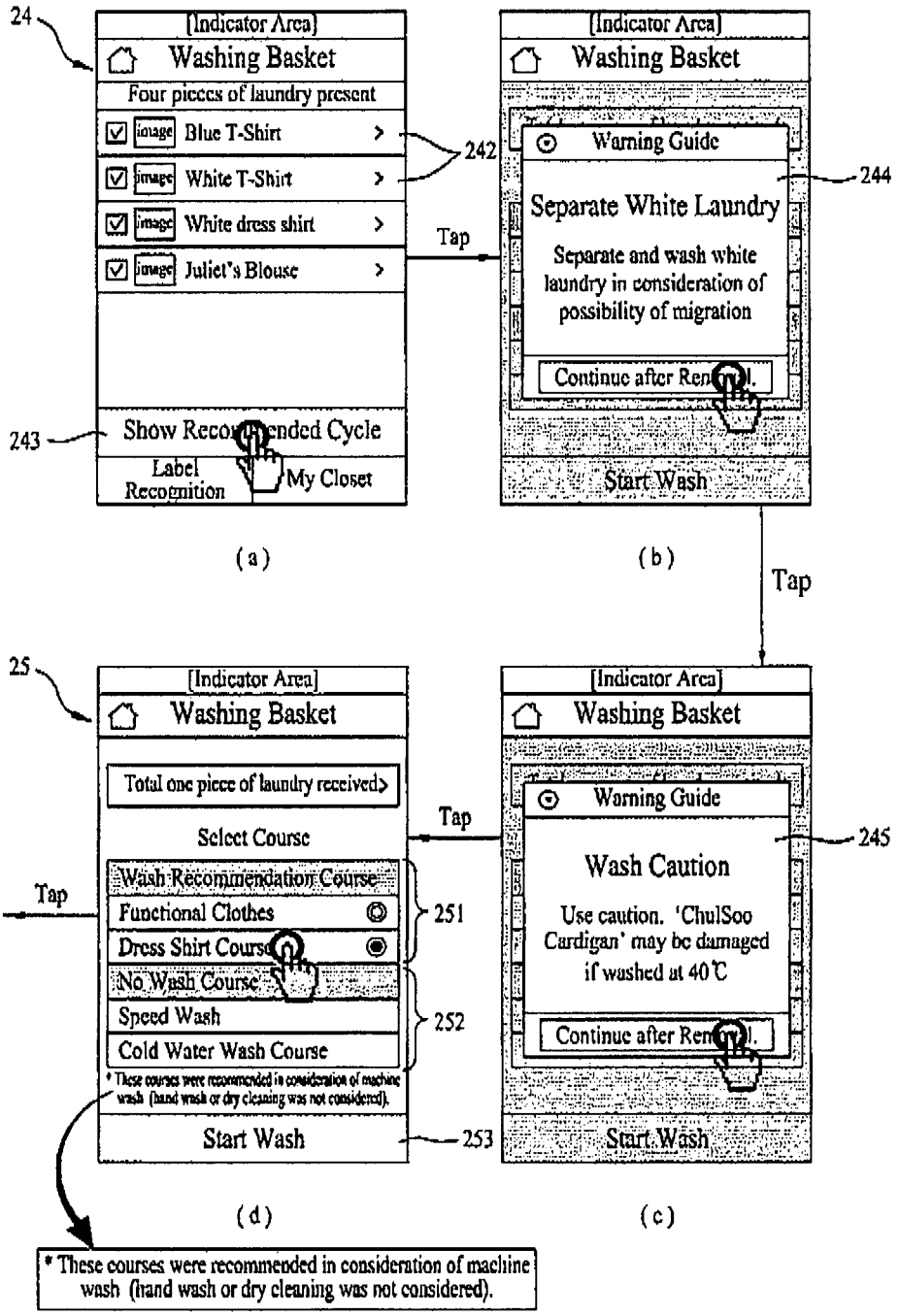
Figure 3B:
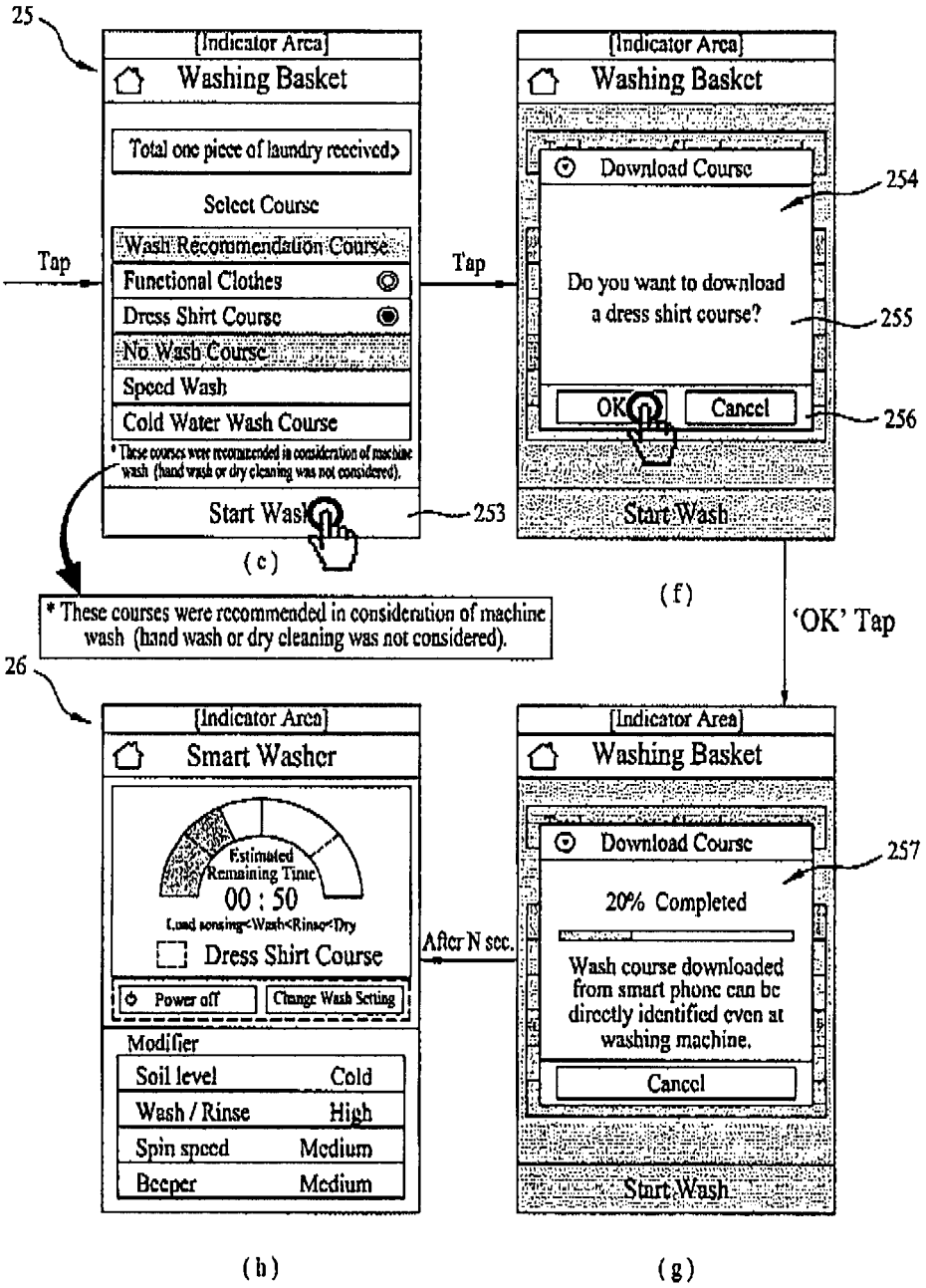

FIG. 3 illustrates the case in which the user pushes the course recommendation request area 243 in a state in which information on multiple pieces of laundry to be washed or dried is input to the portable terminal 100.

If information on multiple pieces of laundry is input via the image capture guidance window 21 or the additional information input window 23, the laundry display area 242 displays information on multiple pieces of laundry (e.g., names of laundry) as illustrated in FIG. 3(*a*).

A difference in ideal treatment methods for different kinds of clothes may make it difficult to wash or dry different clothes at the same time.

Accordingly, if the user pushes the course recommendation request area 243 to request a clothes treatment method for washing or drying multiple pieces of different laundry at the same time despite the fact in that clothes treatment methods suitable for the respective clothes contradict one another, the display unit 110 according to the present invention may display warning windows 2442 and 2452 indicating that the clothes treatment methods contradict one another.

The warning windows may include a migration warning window 2442 as illustrated in FIG. 3(*b*), and a wash water temperature warning window 2452 to warn that suitable temperatures of wash water for different courses contradict one another as illustrated in FIG. 3(*c*).

The warning windows 2442 and 2452 may respectively contain removal request areas 2441 and 2451 to delete information on clothes, suitable clothes treatment methods for which contradict one another, from the basket display window 24. As such, the user may delete information on clothes having a difficulty in washing or drying along with other clothes via the removal request areas 2441 and 2451.

Once information on clothes suitable clothes treatment methods for which contradict one another is removed from the basket display window 24, the display unit 110 displays the recommended course display window 25 as described above.

If the user selects a clothes treatment method of the non-recommended course display area 252 from the recommended course display window 25, the display unit 110 according to the present invention may display a warning window (not shown) to allow the user to select a clothes treatment method displayed in the recommended course display area 251.

As illustrated in FIGS. 3(*d*), 3(*e*), and 3(*f*), even if the user selects a recommended course via the recommended course display area 251 and transmits the recommended course and a command for execution of the recommended course to the clothes treatment apparatus 200 via the control signal transmission area 253, it may be impossible for the user to control the clothes treatment apparatus 200 via the portable terminal 100 so long as the clothes treatment apparatus 200 has no data for execution of the recommended course selected by the user.

Accordingly, to solve the above described problem, the portable terminal 100 according to the present invention has a feature of receiving information on clothes treatment methods not provided in the clothes treatment apparatus 200 from the database 300 and transmitting the information to the clothes treatment apparatus 200.

That is, in the case in which the recommended course selected by the user is a clothes treatment method not stored in the clothes treatment apparatus 200, the display unit 110 displays a new course guidance window 254 as illustrated in FIG. 3(*f*).

The new course guidance window 254 may contain a guide area 255 to guide clothes treatment methods (new courses) not provided in the clothes treatment apparatus 200, and a selection area 256 to identify whether or not to receive information on the clothes treatment methods displayed in the guide area 255 from the database 300.

If the user requests transmission of a new clothes treatment method via the selection area 256, the display unit 110 displays a download display window 257.

After transmission of the new clothes treatment method is completed, the portable terminal 100 according to the present invention transmits the clothes treatment method received from the database 300 to the clothes treatment apparatus 200 via the terminal communication unit 130.

It will be appreciated that the clothes treatment apparatus 200 may be configured to directly receive the new clothes treatment methods from the database 300 when the user requests transmission of the new clothes treatment method via the selection area 256. In this case, the database 300 may be configured to transmit the new clothes treatment method only to the clothes treatment apparatus 200, but not to transmit the new clothes treatment method to the portable terminal 100 (the database 300 may transmit only a name of the new clothes treatment method to the portable terminal 100).

After transmission of the new clothes treatment method to the clothes treatment apparatus 200 is completed, the clothes treatment apparatus 200 executes washing or drying of clothes, and the display unit 110 displays operations of the clothes treatment apparatus 200 in the operating state display window 26 as illustrated in FIG. 3(*h*).

Figure 4A:
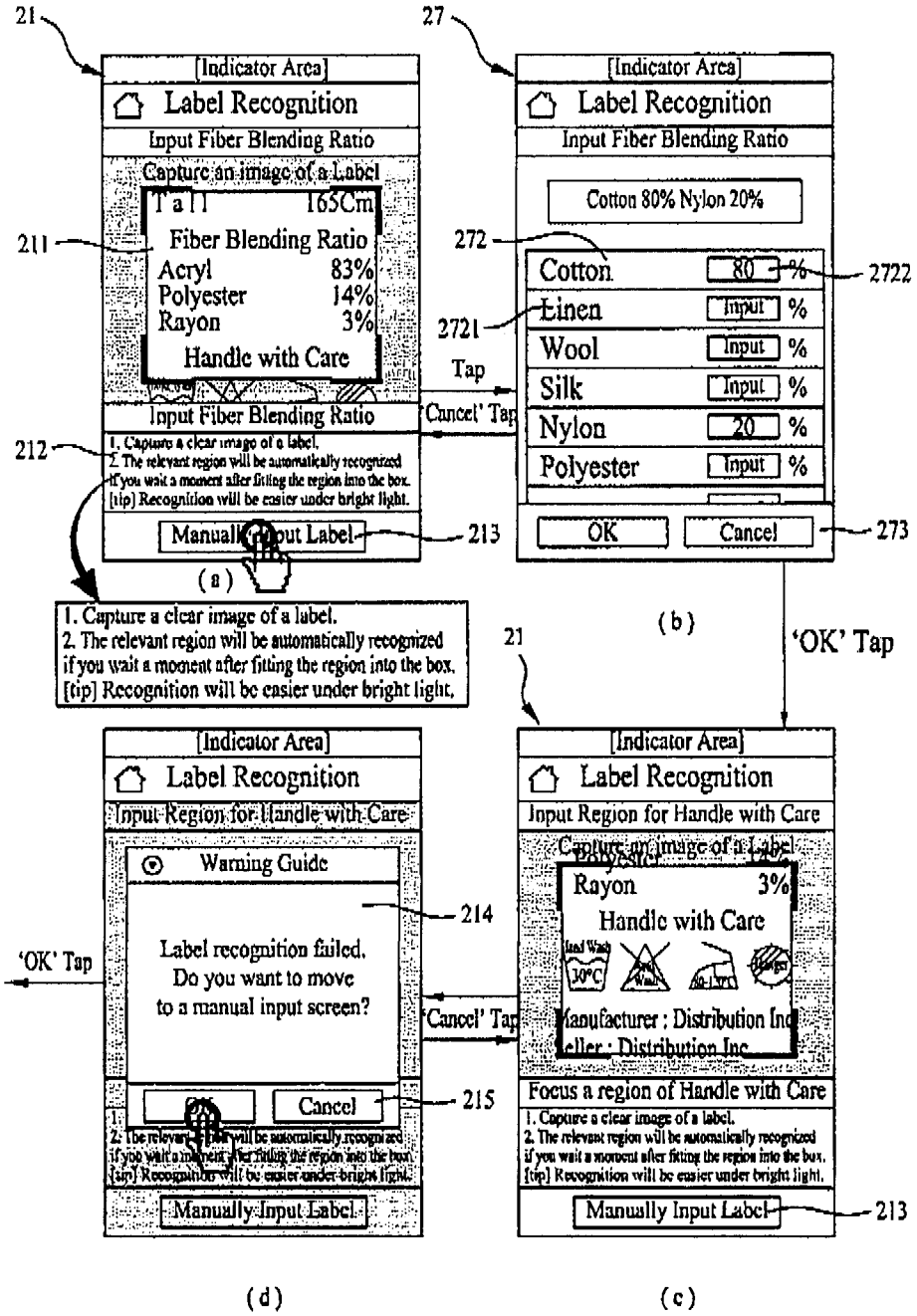
FIG. 4 is a view illustrating a procedure of inputting information printed on the laundry tag to the portable terminal.
Figure 4B:
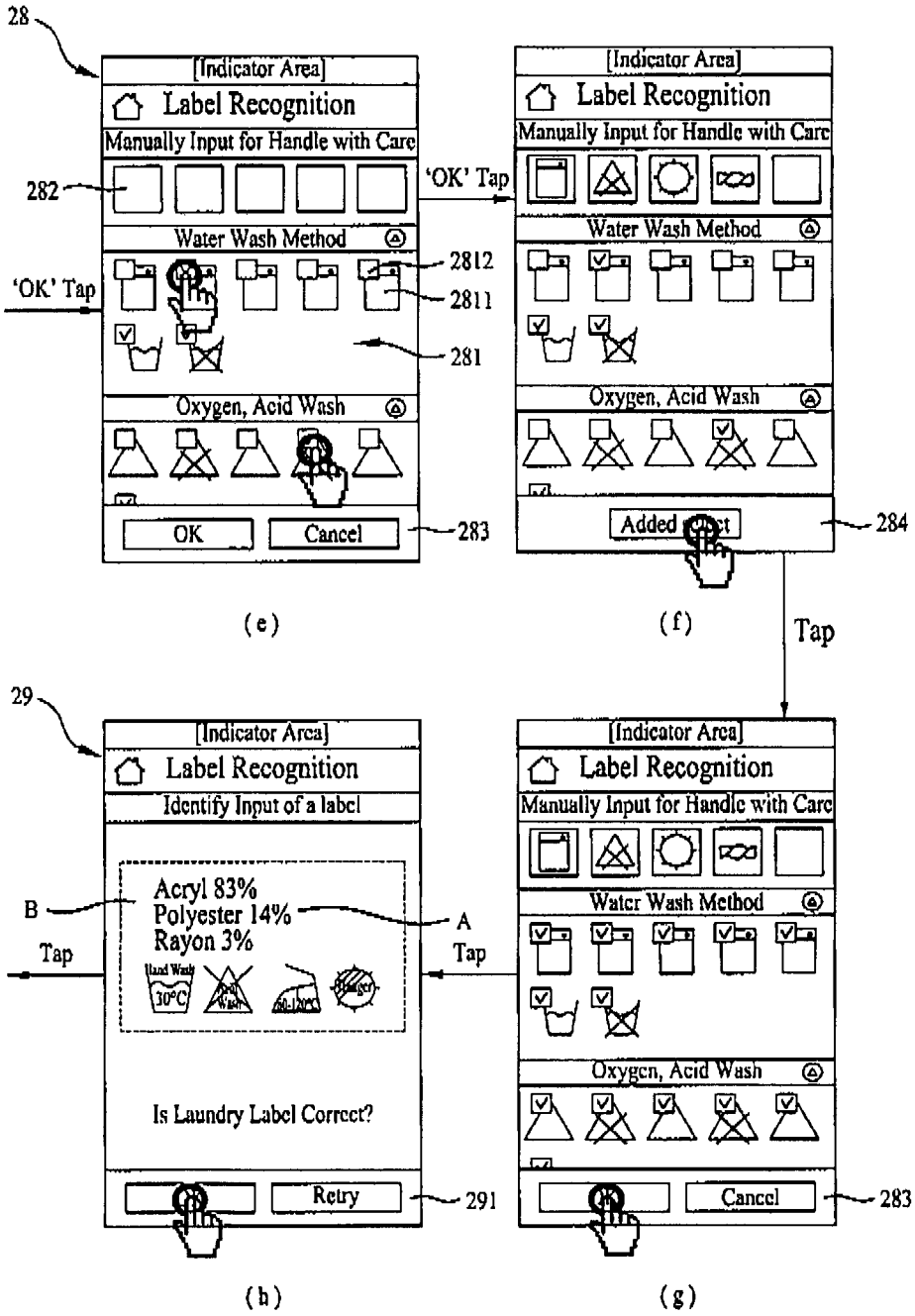
Figure 4C:
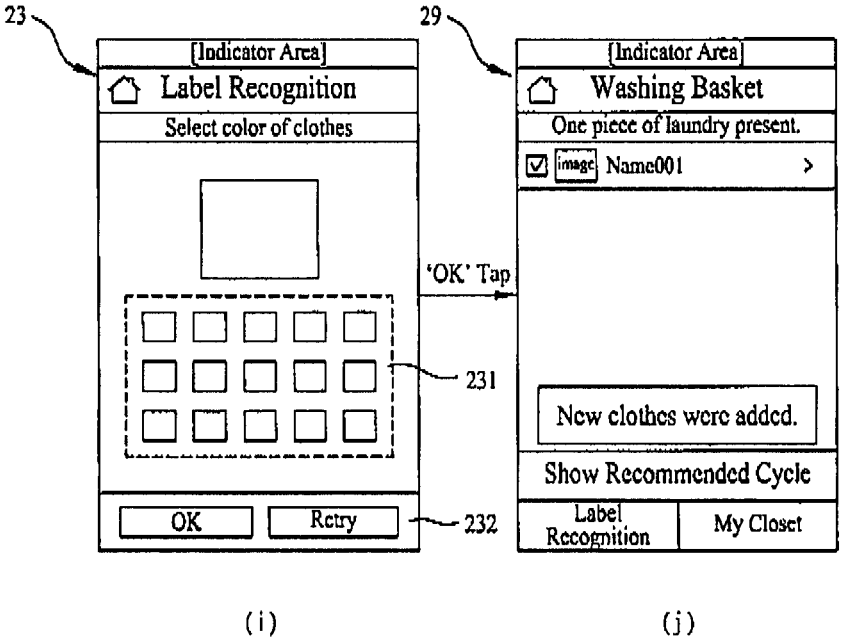

FIG. 4 is a view illustrating a procedure of inputting information printed on a laundry tag to the portable terminal 100 without using the camera.

As described above, if the user selects the tag recognition course recommendation area 11 from the main window 1, the display unit 110 displays the image capture guidance window 21 as illustrated in FIG. 4(*a*).

The image capture guidance window 21 contains a mode selection area 213, in addition to the guide area 211 and the indication area 212.

The mode selection area 213 is an area to select whether clothes information is input using the clothes information input unit 120 such as the camera, or the user directly inputs clothes information without using the clothes information input unit 120.

If the user pushes the mode selection area 213 from the image capture guidance window 21, the display unit 110 first displays any one of a fiber blending ratio input window 27 and a laundry care symbol input window 28. FIG. 4(*b*) illustrates the case in which the fiber blending ratio input window 28 is displayed first.

The fiber blending ratio input window 27 contains a fiber blending ratio input area 272 and an input result identification area 273.

The fiber blending ratio input area 272 contains a name display area 2721 to display names of constituent fibers of clothes, and a ratio input area 2722 to input a constituent ratio of fibers. Accordingly, the user can input a constituent ratio (content rate, etc.) of relevant fibers to the ratio input area 2722 based on the fiber blending ratio of clothes printed on a laundry tag.

Although not illustrated in the drawings, if the user pushes the ratio input area 2722, a keypad window by which input of characters is possible may be displayed on the fiber blending ratio input window 27.

Information input via the ratio input area 2722 may be identified via an input result display area 271. If the fiber blending ratio of clothes displayed in the input result display area 271 coincides with the fiber blending ratio of clothes that the user intends to input, the user can complete input of the fiber blending ratio of clothes by pushing the input result identification area 273.

After input of the fiber blending ratio of clothes is completed, the display unit 110 may directly display the laundry care symbol input window 28, and may display the image capture guidance window 21 as illustrated in FIG. 4(*c*).

Accordingly, differently from input of the fiber blending ratio of clothes, input of laundry care symbols may be performed via the clothes information input unit 120 such as the camera.

It will be appreciated that the display unit 110 may display the laundry care symbol input window 28 if the user pushes the mode selection area 213 from the image capture guidance window 21.

Meanwhile, even if the user requests image capture of a laundry tag via the image capture request unit 150, the controller 170 may fail to recognize a captured image of the laundry tag when the laundry tag is damaged, when laundry care symbols printed on the laundry tag are not clear, when the clothes information input unit 120 malfunctions, etc.

In this case, the display unit 110 displays a guidance window 214 as illustrated in FIG. 4(*d*).

The guidance window 214 displays a mode conversion request area 215 to request display of the laundry care symbol input window 28 to allow the user to directly input laundry care symbols.

If the user pushes the mode conversion request area 215, the display unit 110 displays the laundry care symbol input window 28 as illustrated in FIG. 4(*a*). The laundry care symbol input window 28 contains a laundry care symbol selection area 281, a selected result identification area 283, and a selected result display area 282.

The laundry care symbol selection area 281 contains a symbol display area 2811 to display laundry care symbols, and an input area 2812 to enable selection of the laundry care symbols displayed in the symbol display area 2811.

Accordingly, the user can select a laundry care symbol via the input area 2812, identify the selected laundry care symbol via the selected result display area 282, and causes the selected laundry care symbol to be stored in the storage unit 160 via the selected result identification area 283.

It will be appreciated that the display unit 110 may display a reselection identification window 284 in the laundry care symbol input window 28 via the input area 2812 during selection of the laundry care symbol, thereby allowing the user to input all the laundry care symbols (FIG. 4(*f*)).

Meanwhile, if the user pushes the selected result identification area 283 as illustrated in FIG. 4(*g*), the display unit 110 displays an input result display window 29 as illustrated in FIG. 4(*h*). A context to be subsequently displayed on the display unit 110 is equal to that illustrated in FIG. 2(*e*), FIG. 2(*f*) and FIG. 3, and thus a detailed description thereof will be omitted.

Figure 5A:
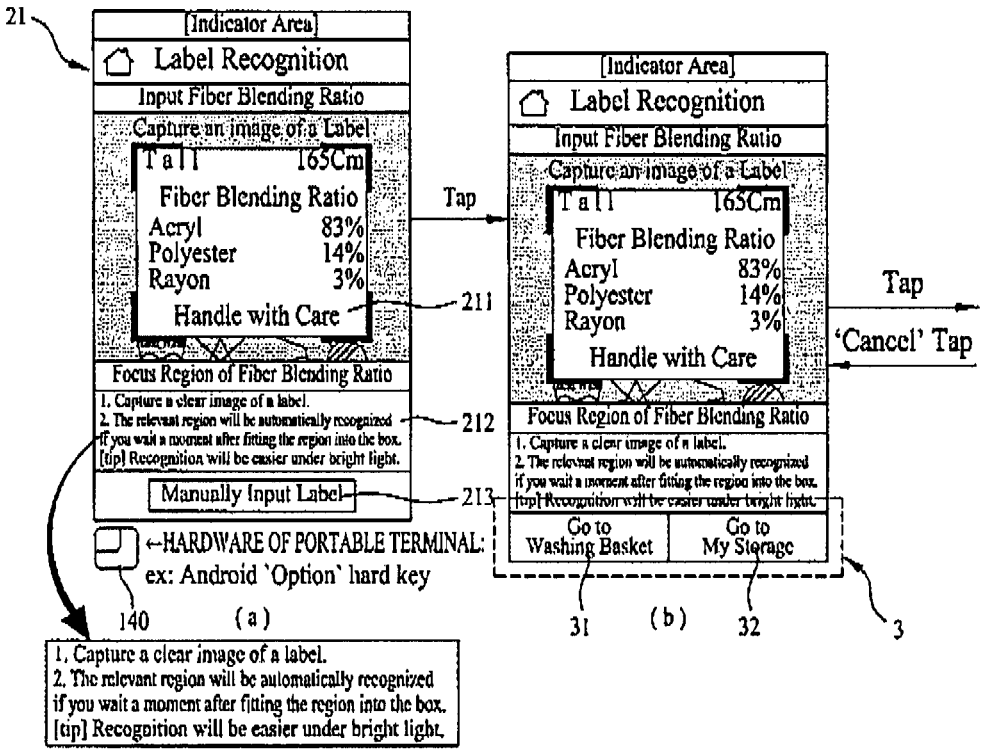
FIG. 5 is a view illustrating a procedure of requesting display of clothes information stored in a storage unit.
Figure 5B:
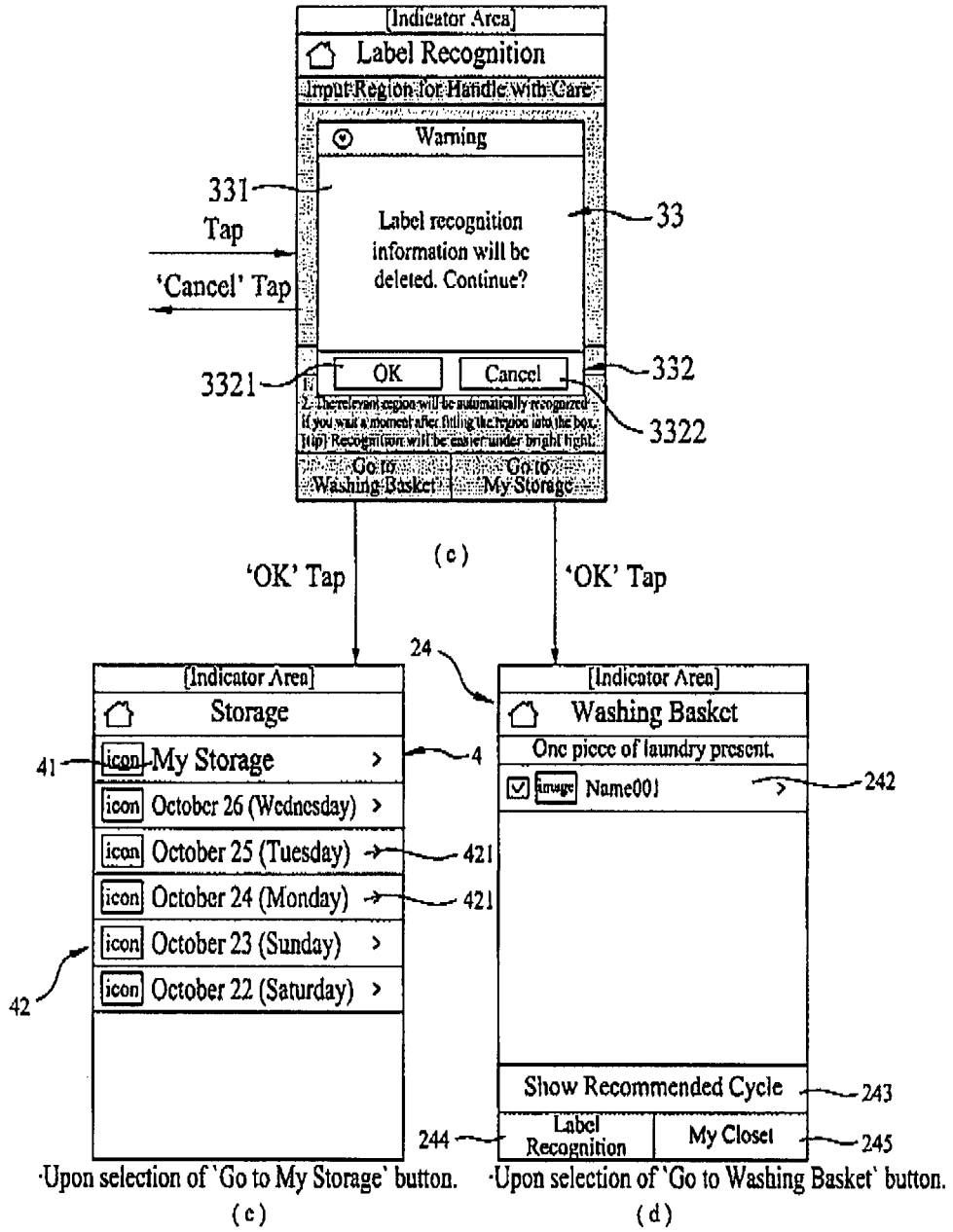

FIG. 5 illustrates a procedure of managing clothes information stored in the storage unit 160. If the user pushes the information request unit 140 provided at the portable terminal 100, the display unit 110 displays information stored in the storage unit 160.

The information request unit 140 may take the form of a physical button (hardware key) provided at the portable terminal 100, or may take the form of a software key displayed on the display unit 110.

The storage unit 160 stores information input via the clothes information input unit 120 or the input windows 27 and 28, so-called history information that is information displayed as one by binding information input on the same date among the information input via the clothes information input unit 120 or the input windows 27 and 28, and item list information acquired by categorizing the history information on a per clothes name basis.

If the user pushes the information request unit 140 in a state in which the image capture guidance window 21 is displayed on the display unit 110, the display unit 110 according to the present invention displays an information selection window 3.

The information selection window 3 may contain a basket information request area 31 to request display of the basket display window 24, and a stored information request area 32 to request display of the history information and the item list information (FIG. 5(*b*)).

The basket display window 24, as described above, is a laundry display window to display laundry to be washed or dried via the clothes treatment apparatus 200.

As illustrated in FIG. 5(*d*), the basket display window 24 may further contain a list request area 245 to request display of the history information and the item list information in the basket display window 24. The list request area 245 may have the same function as the stored information request area 32 of FIG. 5(*b*).

That is, information displayed on the display unit 110 when the user pushes the list request area 245 may be equal to information displayed on the display unit 110 when the user pushes the stored information request area 32.

In the case in which the user pushes the information request unit 140 while clothes information is being input via the clothes information input unit 120, the display unit 110 may display a warning window 33 as illustrated in FIG. 5(*c*) to warn deletion of the clothes information being input.

If the warning window 33 is displayed, the user may prevent deletion of the clothes information ('Cancel' 3322), and may request display of the basket display window 4 or a stored information display window 4 ('OK' 3321) via an identification area 332.

The stored information display window 4, as illustrated in FIG. 5(*e*), may contain a history selection area 42 to display history information acquired by categorizing clothes information input via the clothes information input unit 120 or the input windows 27 and 28 on a per date basis, and an item list request area 41 to request that clothes information stored in the storage unit 160 be categorized and displayed on a per name basis.

That is, a variety of clothes information stored on the same date constitutes single history information displayed on a per information storage date basis and is displayed in the history selection area 42.

The item list request area 41 is an area to request that all clothes information stored in the storage unit 160 be displayed on the display unit 110. The clothes information is displayed on a per clothes name basis or on a per category basis.

Figure 6A:
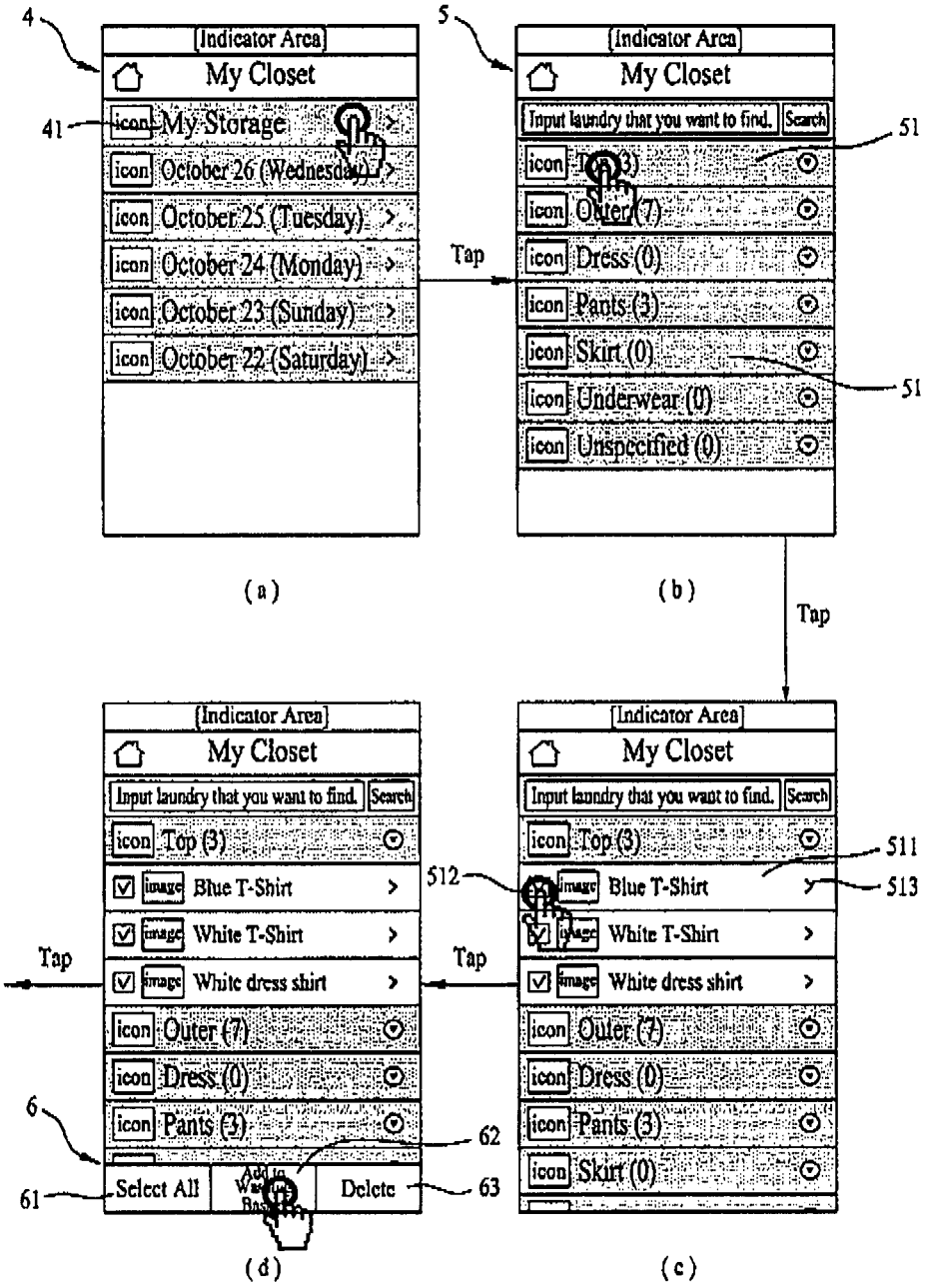
FIG. 6 is a view illustrating a procedure of managing an item list (a clothes information list) stored in the storage unit.
Figure 6B:
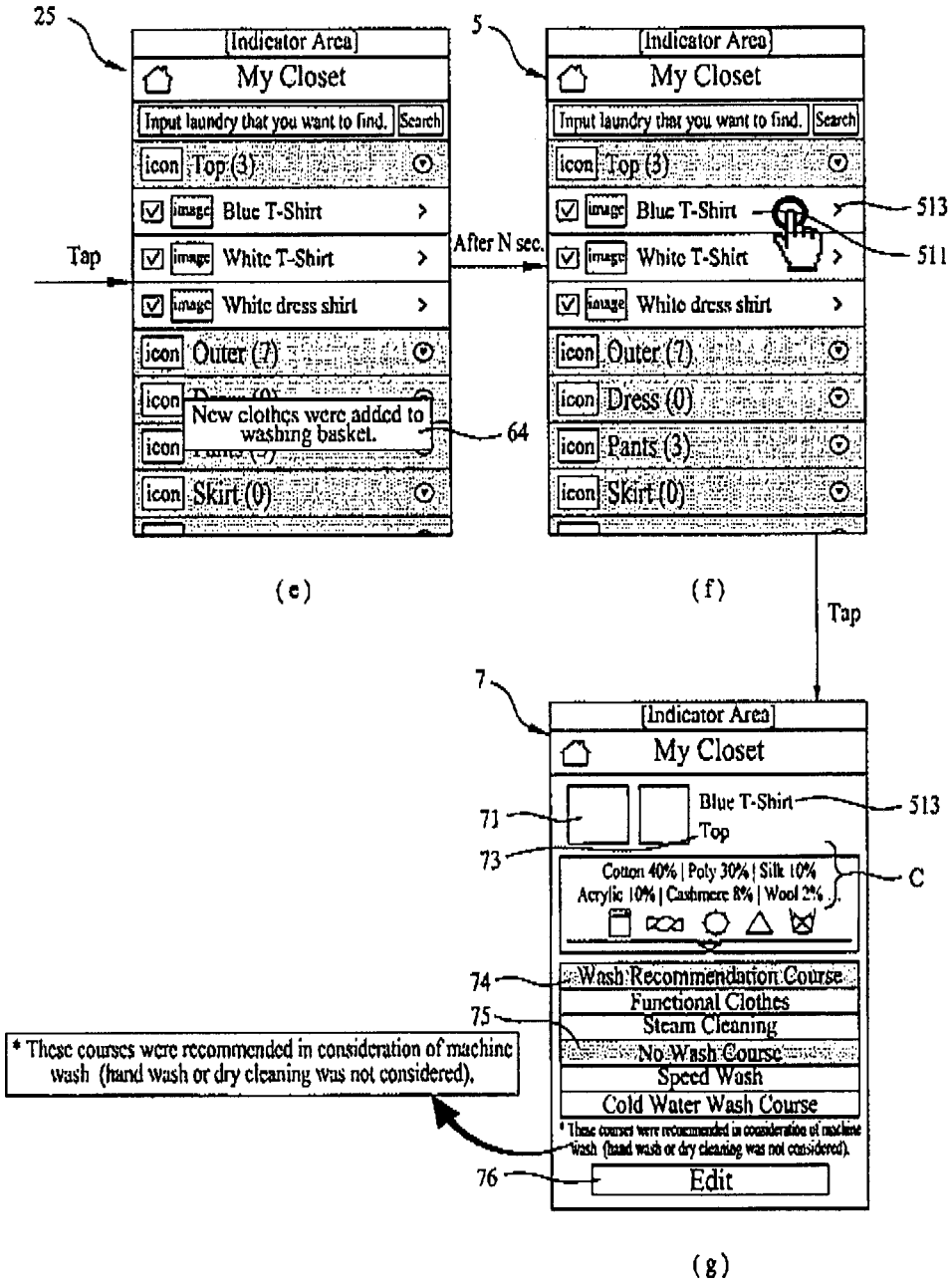

As illustrated in FIGS. 6(*a*) and 6(*b*), if the user pushes the item list request area 41 from the stored information display window 4, the display unit 110 displays an item list display window 5.

The item list display window 5 may contain a plurality of category selection areas 51 that classify clothes information based on a particular criteria (the kind of clothes, etc.)

If the user pushes one of the category selection areas 51, the display unit 110 displays item display areas 511 where clothes information included in a selected category is enumerated on a per clothes name basis as illustrated in FIG. 6(*c*).

The item display area 511 contains an item selection area 512 and an item information request area 513.

The user can select particular clothes information via the item selection area 512, and can request that the particular clothes information be displayed on the display unit 110 via the item information request area 513.

If the user selects the particular clothes information via the item selection area 512, the item list display window 5 displays an item management window 6 as illustrated in FIG. 6(*d*).

The item management window 6 may be a pop-up window, and may contain a select-all area 61 to select all the clothes information included in a particular category, a basket storage request area 62 to move the selected clothes information to the laundry display area 242 of the basket display window 24, and a deletion request area 63 to request deletion of the selected clothes information.

Accordingly, when it is necessary to wash or dry clothes, information of which is stored in the storage unit 160, the user can select the corresponding clothes information from the item list display window 5 and transmit the selected information to the laundry display area 242 of the basket display window 24 without requiring that the clothes information be re-input to the portable terminal 100 via the clothes information input unit 120 or the input windows 28 and 29.

If the user pushes the basket storage request area 62, the item list display window 5 may display a result notification window 64 to notify that the selected clothes information is stored in the laundry display area 242 of the basket display window 24 (FIG. 6(*e*)).

Meanwhile, if the user pushes the item information request area 513 of the item display area 511, the display unit 110 may display an item information display window 7 as illustrated in FIG. 6(*g*).

The item information display window 7 may contain an image display area to display an image of clothes, a name display area 72 to display a name of clothes, a category display area 73 to display a category including relevant clothes, a symbol display area C to display the fiber blending ratio of clothes and laundry care symbols, a recommended course display area 74 to display a suitable clothes treatment method for clothes, and a non-recommended course display area 75 to display an unsuitable clothes treatment method for clothes.

The item information display window 7 may further contain an edit request area 76 for modification of displayed clothes information.

Figure 7A:
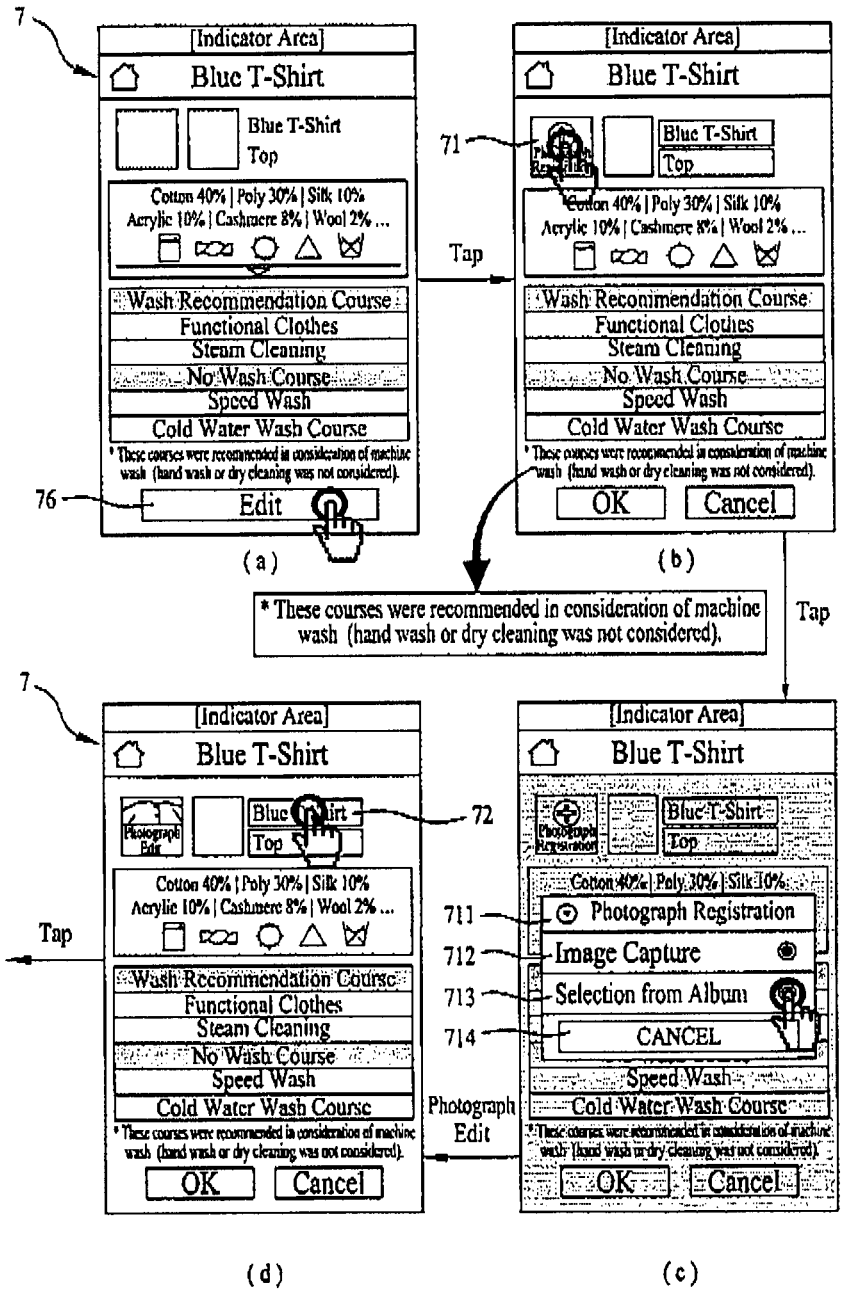
FIGS. 7 and 8 are views illustrating a procedure of editing clothes information.
Figure 7B:
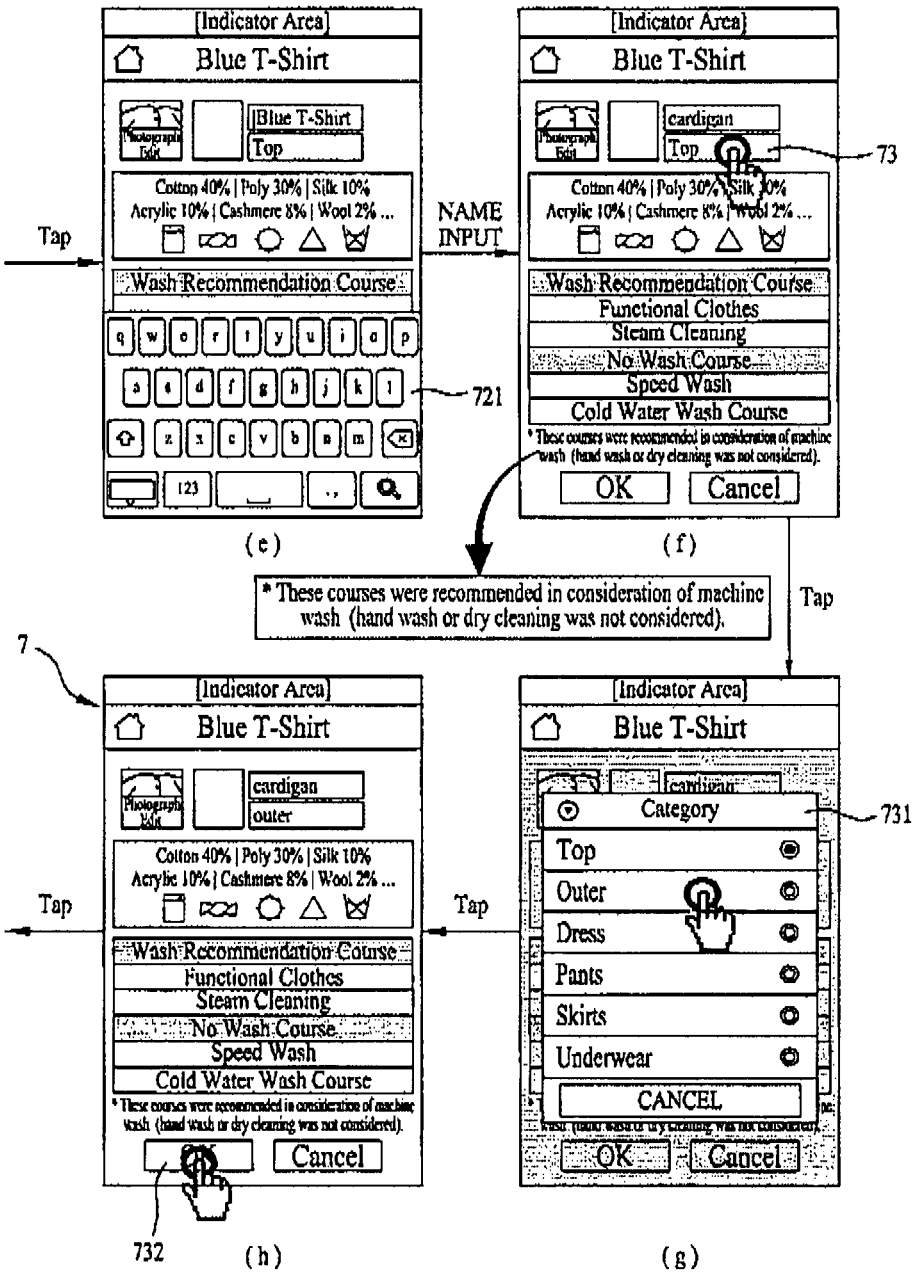
Figure 7C:
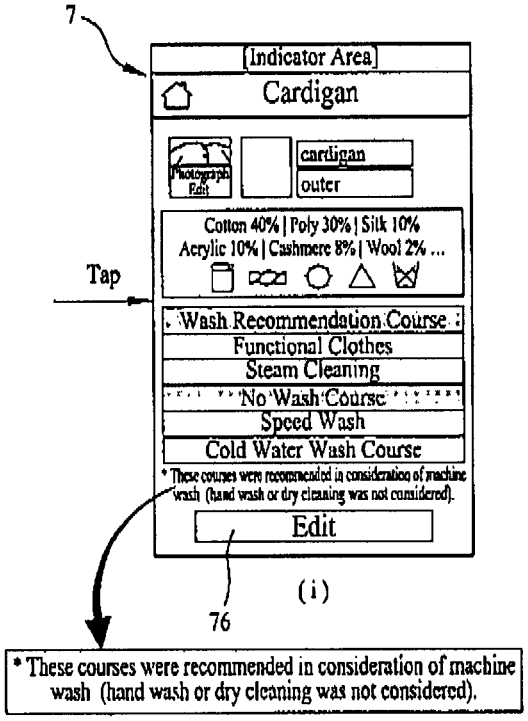

FIG. 7 illustrates a procedure of editing clothes information displayed in the item information display window 7. If the user pushes the edit request area 76, each area included in the item information display window 7 is changed into an edit request area of relevant information.

That is, if the user pushes the edit request area 76 and the image display area 71 in this sequence, the image display area 71 is changed into an image edit request area. As such, the item information display window 7 displays an image edit window 711 as the user pushes the image display area 71.

The image edit window 711, as illustrated in FIG. 7(*c*), may contain an image capture request area 712, a stored image transmission request area 713, and an edit cancel area 714.

The image capture request area 712 serves to request image capture of clothes using the clothes information input unit 120. The stored image transmission request area 713 serves to request display of an image of clothes stored in the storage unit 160 in the image display area 71.

Meanwhile, if the user pushes the edit request area 76 and the name display area 72 in this sequence, the item information display window 7 displays a keypad window 721 as illustrated in FIGS. 7(*d*) and 7(*e*).

Also, if the user pushes the edit request area 76 and the category display area 73 in this sequence, the keypad window 721 may be displayed in the item information display window 7 as illustrated in FIG. 7(*e*), and a category selection window 731 may be displayed in the item information display window 7 as illustrated in FIG. 7(*g*).

As the user edits clothes information via the edit request area 76, the item information display window 7 may display an edit identification request window 732 to identify whether or not to store edited information. If the user approves storage via the edit identification request window 732, the display unit 110 may again display the item information display window 7.

Figure 8A:
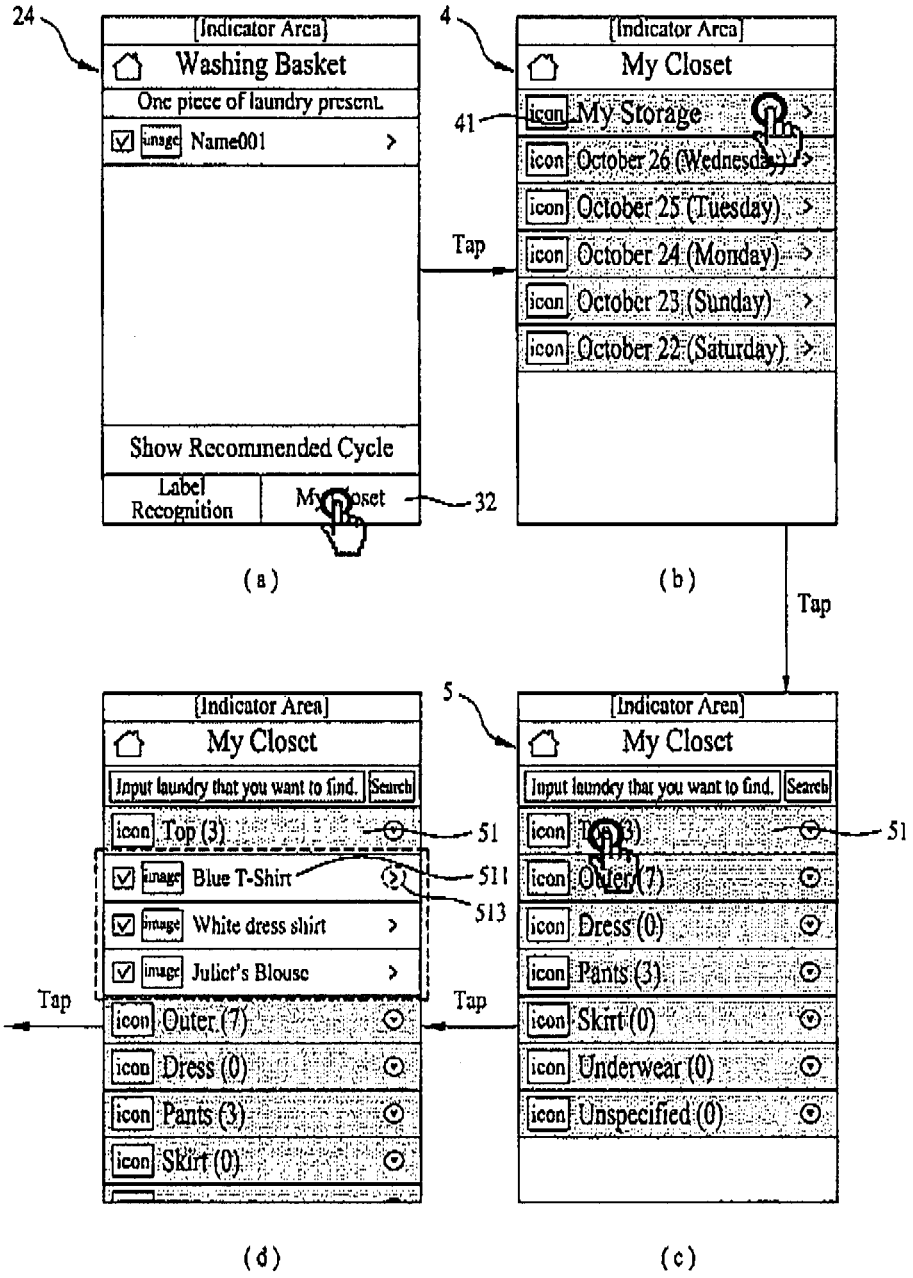
Figure 8B:
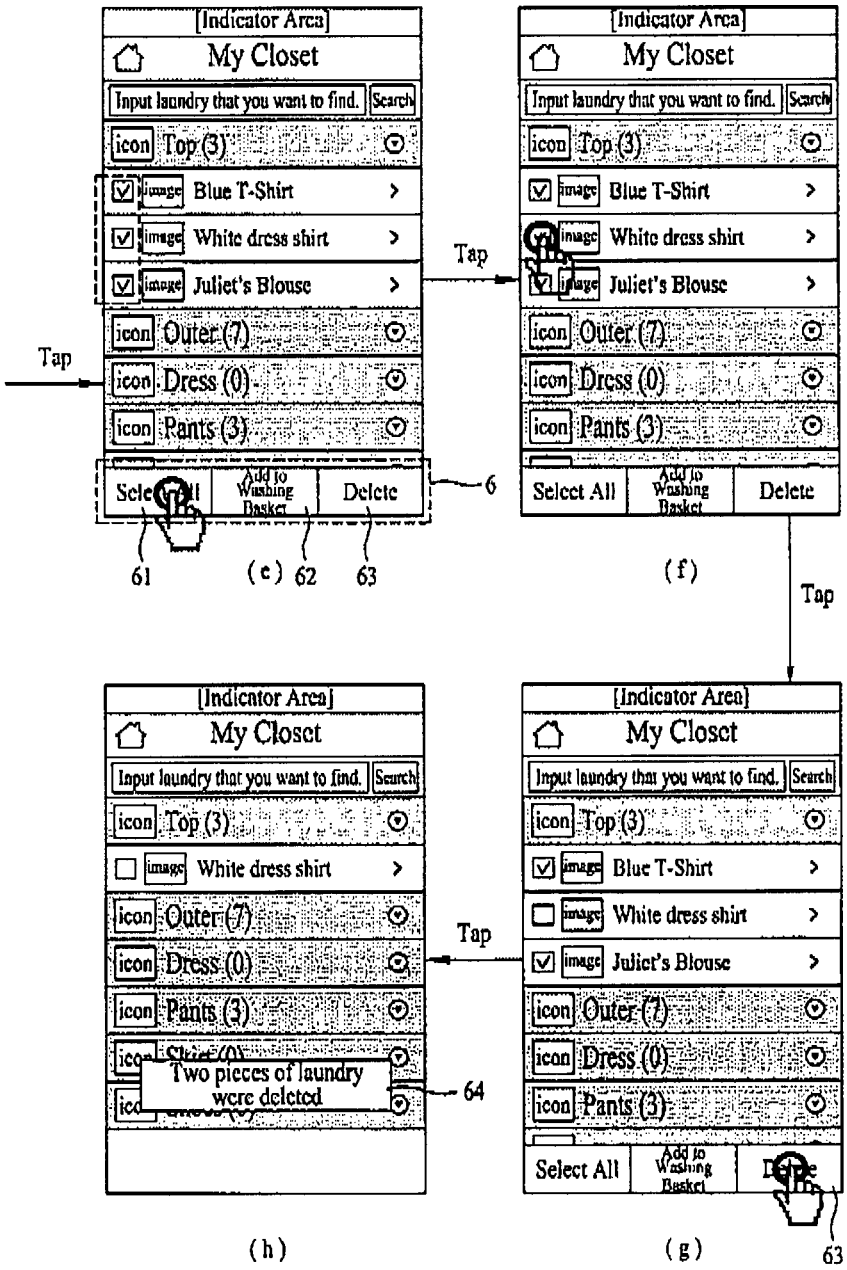

FIG. 8 illustrates a procedure of selecting or deleting all clothes information via the item management window 6 of the item list display window 5.

If the user pushes the select-all area 61 from the item management window 6, all clothes information included in a particular category is selected as illustrated in FIG. 8(*e*).

Meanwhile, if the user pushes the deletion request area 63 from the item management window 6, the selected clothes information is deleted from the category as illustrated in FIGS. 8(*f*), 8(*g*) and 8(*h*). In this case, the item list display window 5 may display a result notification window 64 as illustrated in FIG. 8(*h*).

Figure 9A:
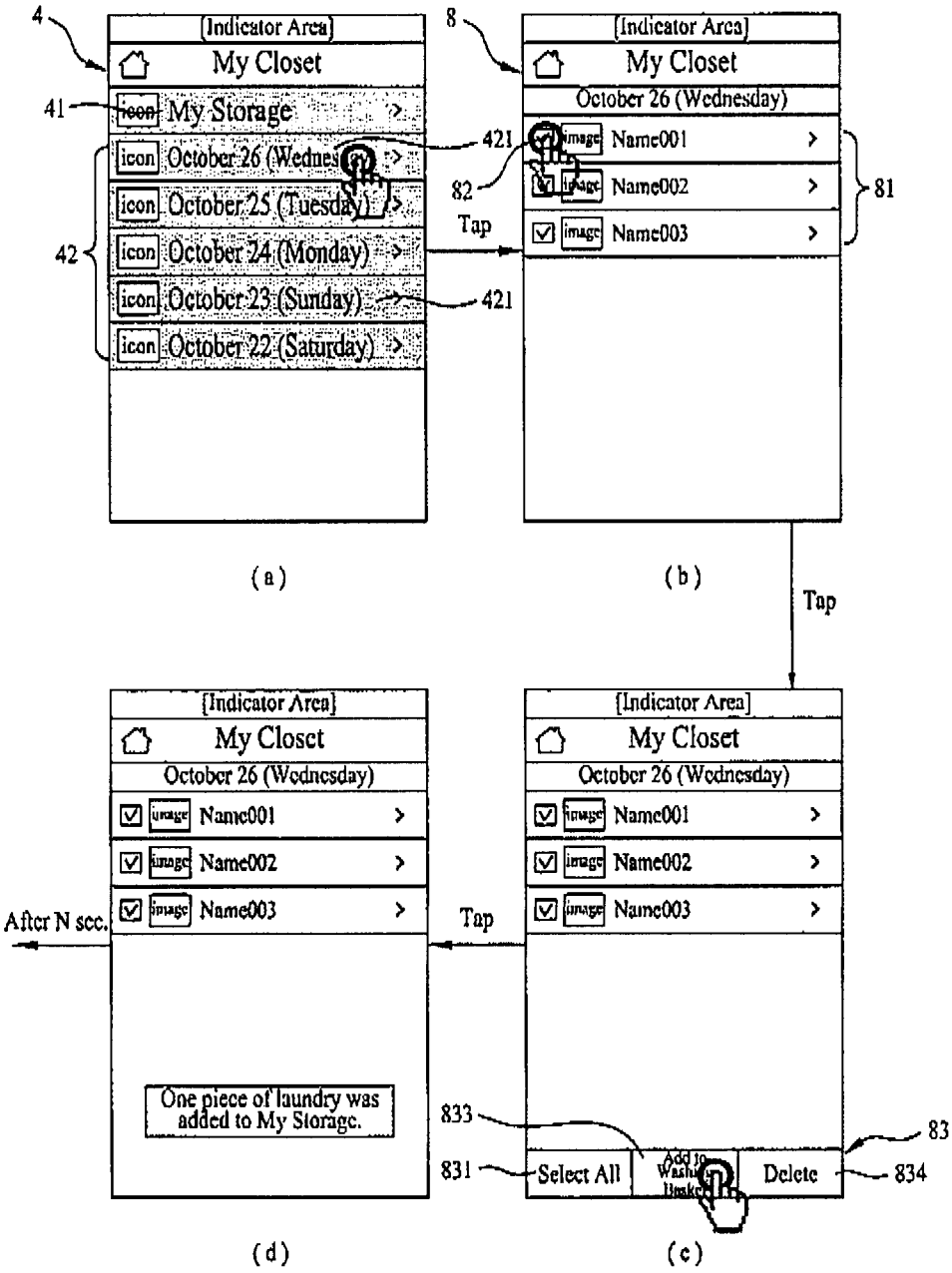
FIG. 9 is a view illustrating a procedure of searching for so-called history information and editing clothes information.
Figure 9B:
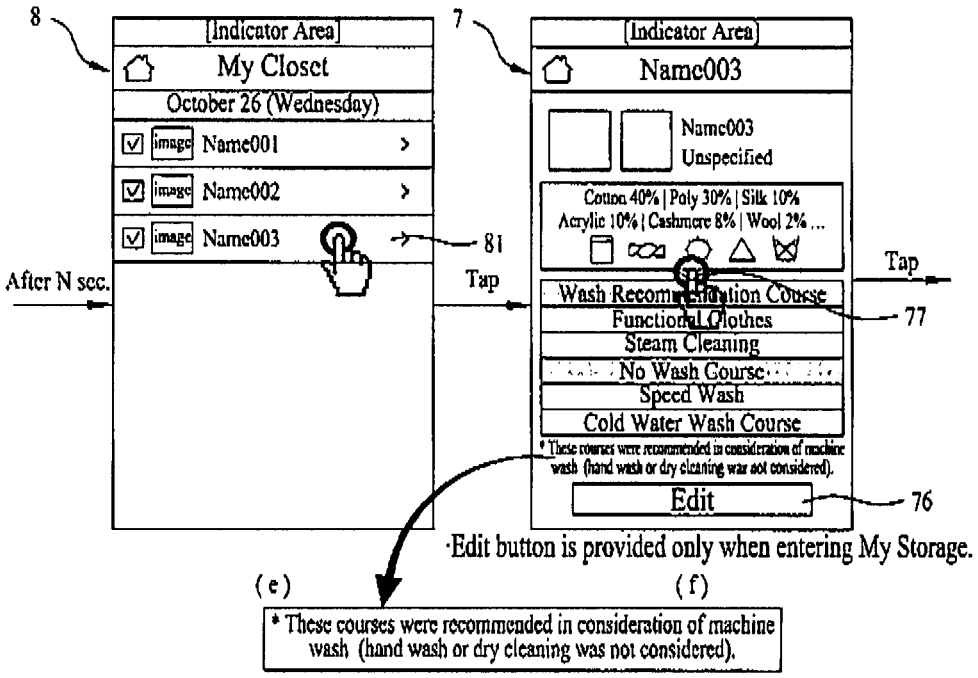
Figure 9C:
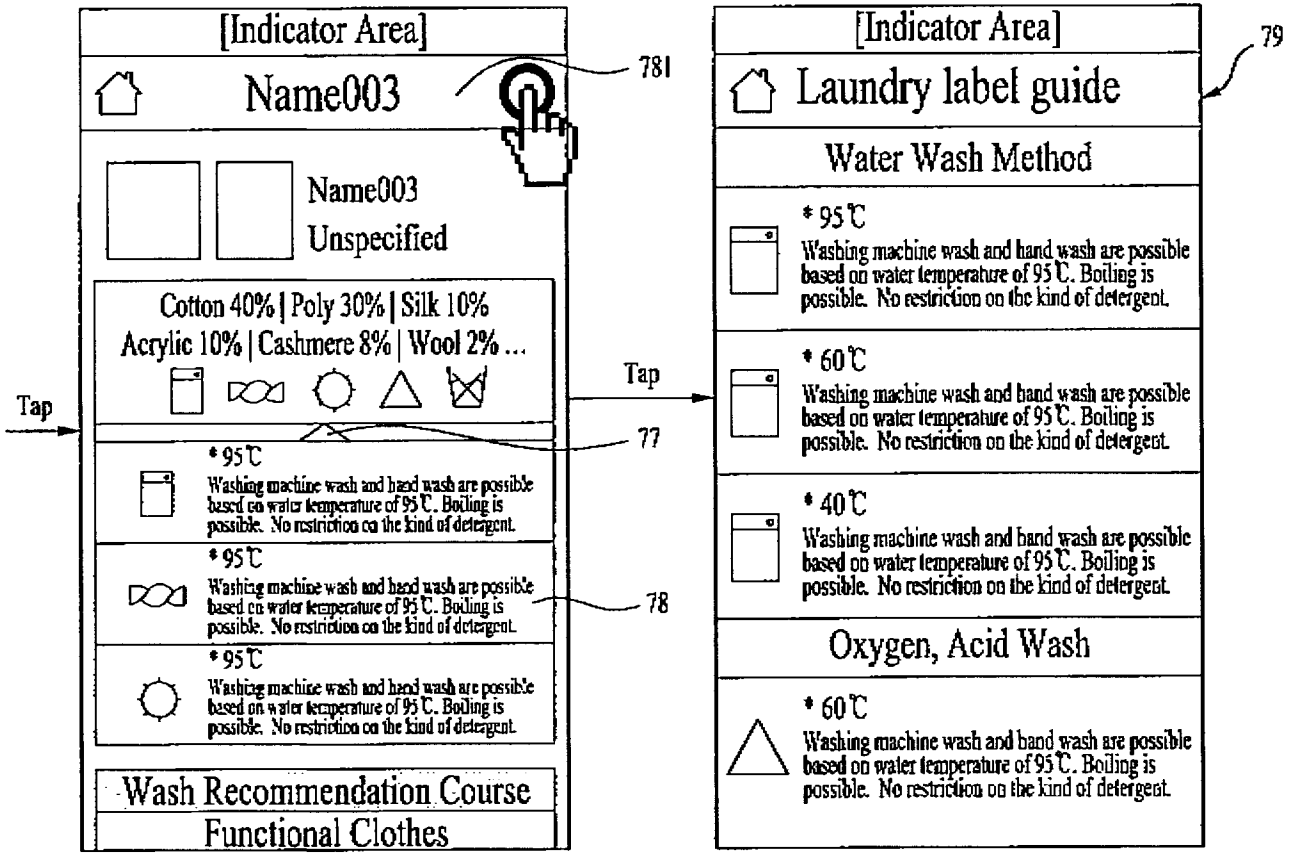

FIG. 9 is a view illustrating a procedure of searching for history information and editing clothes information.

As described above with reference to FIG. 5, if the user requests that information stored in the storage unit 160 be displayed on the display unit 110 via the information request unit 140, the display unit 110 displays the information selection window 3 containing the basket request area 31 and the stored information request area 32.

If the user pushes the stored information request area 32 of the information selection window 3, the stored information display window 4 is displayed. A history selection area 42 is displayed in the stored information display window 4.

The history selection area 42 is a space in which clothes information stored on the same date is displayed as single history information. As illustrated in FIG. 9(*a*), if the user selects history information of a particular date, the display unit 110 displays a laundry display window 8 to display a list of clothes information stored on the corresponding date.

The laundry display window 8 contains a laundry display area 81 to display a list of clothes information stored on the corresponding date.

The laundry display window 8 contains a laundry selection area 82. The user can select corresponding clothes information by pushing the laundry selection area 82. If the user pushes the laundry selection area 82, the laundry display window 8 may display an edit request window 83.

The edit request window 83 may contain a select-all area 831 to select all clothes information displayed, an item addition request area 833 to store selected clothes information in an item list, and a deletion request area 834 to request deletion of the selected clothes information.

As illustrated in FIG. 9(*c*), if the user pushes the item addition request area 833 from the edit request window 83, the selected clothes information is stored in the item list. The clothes information moved to the item list via the item addition request area 833 may be identified via the item list request area 41 (see FIG. 6).

Meanwhile, if the user pushes the item addition request area 833, the laundry display window 8 may display a storage identification window 835 to notify that selected clothes information is stored in the item list (FIG. 9(*d*)).

The user can identify and modify clothes information displayed in the laundry display window 8. This procedure is as illustrated in FIG. 9(*e*) to FIG. 9(*h*).

That is, if the user pushes the laundry display area 81, the display unit 110 displays the item information display window 7 (FIG. 9(*f*)). The item information display window 7 includes the edit request area 76 as described above with reference to FIG. 7. Thus, the user can edit clothes information via the above described procedure of FIG. 7.

The item information display window 7 contains a detailed information request area 77. If the user pushes the detailed information request area 77, the item information display window 7 displays a detailed information display area 78 in which explanation about a handling method of clothes (meaning of laundry care symbols) is displayed (FIG. 9(*g*)).

If the user pushes the detailed information request area 77 in a state in which the detailed information display area 78 is displayed, the detailed information display area 78 disappears from the item information display window 7.

Meanwhile, if the user pushes a name area 781 of clothes information from the item information display window 7, the display unit 110 may display a handling method display window 79 to display explanation of laundry care symbols of clothes (FIG. 9(*h*)).

Accordingly, the user can identify meaning of the laundry care symbols displayed in the item information display window 7 from the handling method display window 79.

Figure 10A:
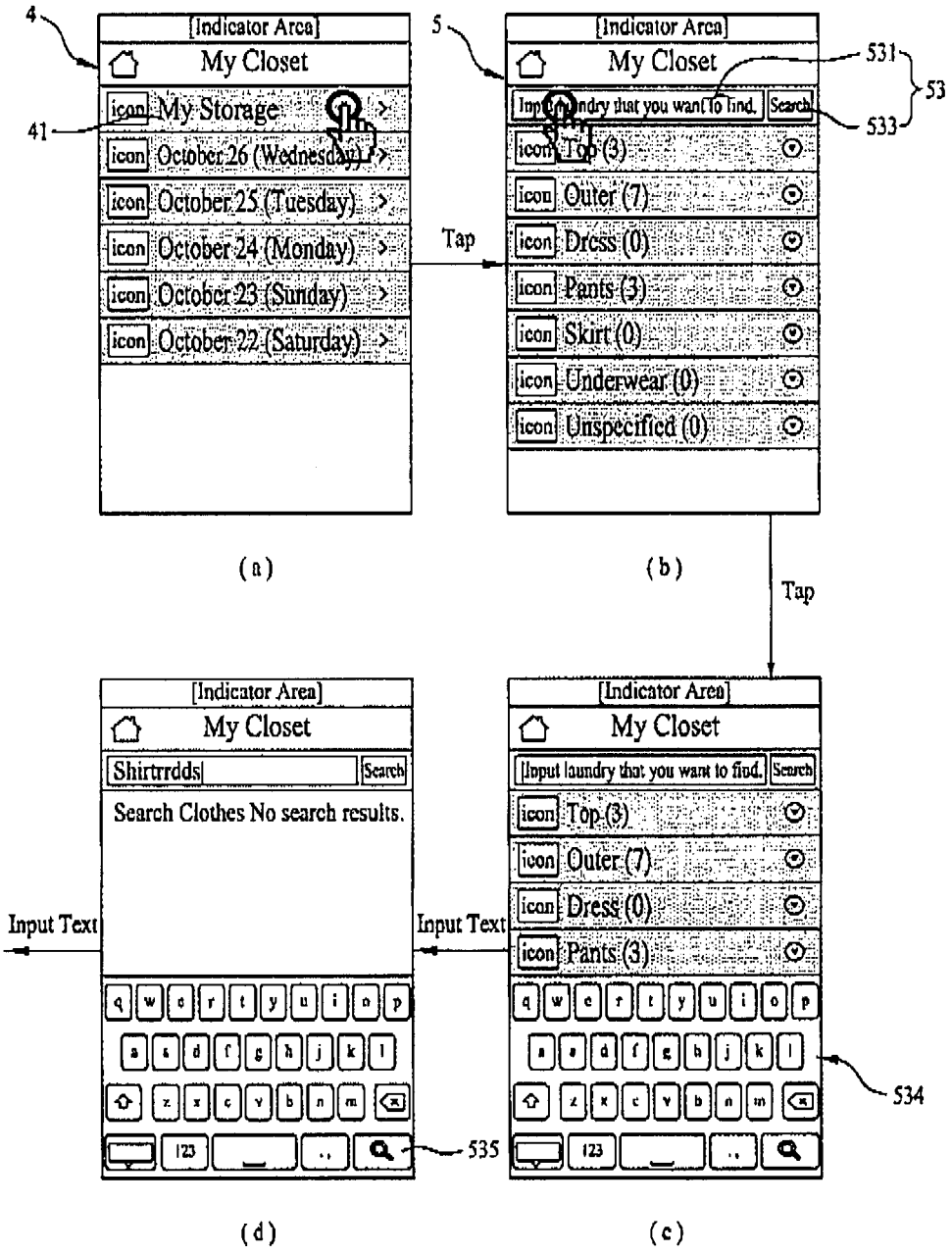
FIG. 10 is a view illustrating a procedure of searching for clothes information via the portable terminal.
Figure 10B:
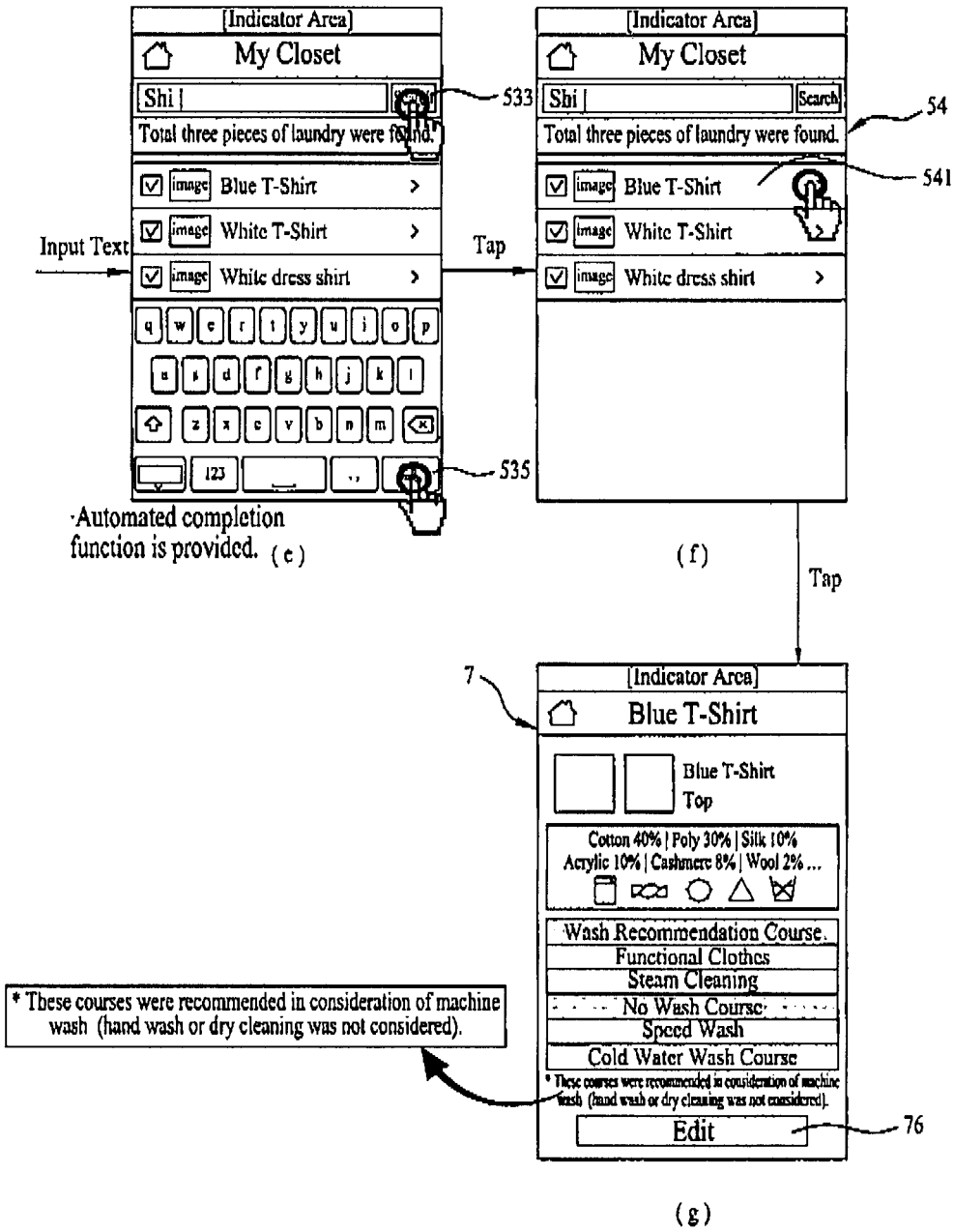

FIG. 10 is a view illustrating a procedure of searching for clothes information via the portable terminal 100.

If the user pushes the item list request area 41 from the stored information display window 4, the display unit 110 displays the item list display window 5 illustrated in FIG. 10(*b*).

The item list display window 5 contains an item search area 53. The item search area 53 may contain a typing area 531 for input of characters or symbols, and a search request area 533 to request search of content input to the typing area 531.

If the user pushes the typing area 531, the item list display window 5 displays a keypad window 534. Thus, the user may input data of clothes information that can be specified, such as a name of clothes, to the typing area 531 via the keypad window 534.

After input of characters or symbols to the typing area 531 is completed, the user may request search via the search request area 533 provided in the item search area 53 or the search request area 535 provided in the keypad window 534 (FIG. 10(*e*)).

If the user pushes the search request areas 535 and 533, the display unit 110 displays a searched result display window (54, FIG. 10(*f*)). The searched result display window 54 contains an item display area 541 to display clothes information.

Meanwhile, if the user pushes the item display area 541, the display unit 110 displays the item information display window 7 as illustrated in FIG. 10(*g*).

Figure 11:
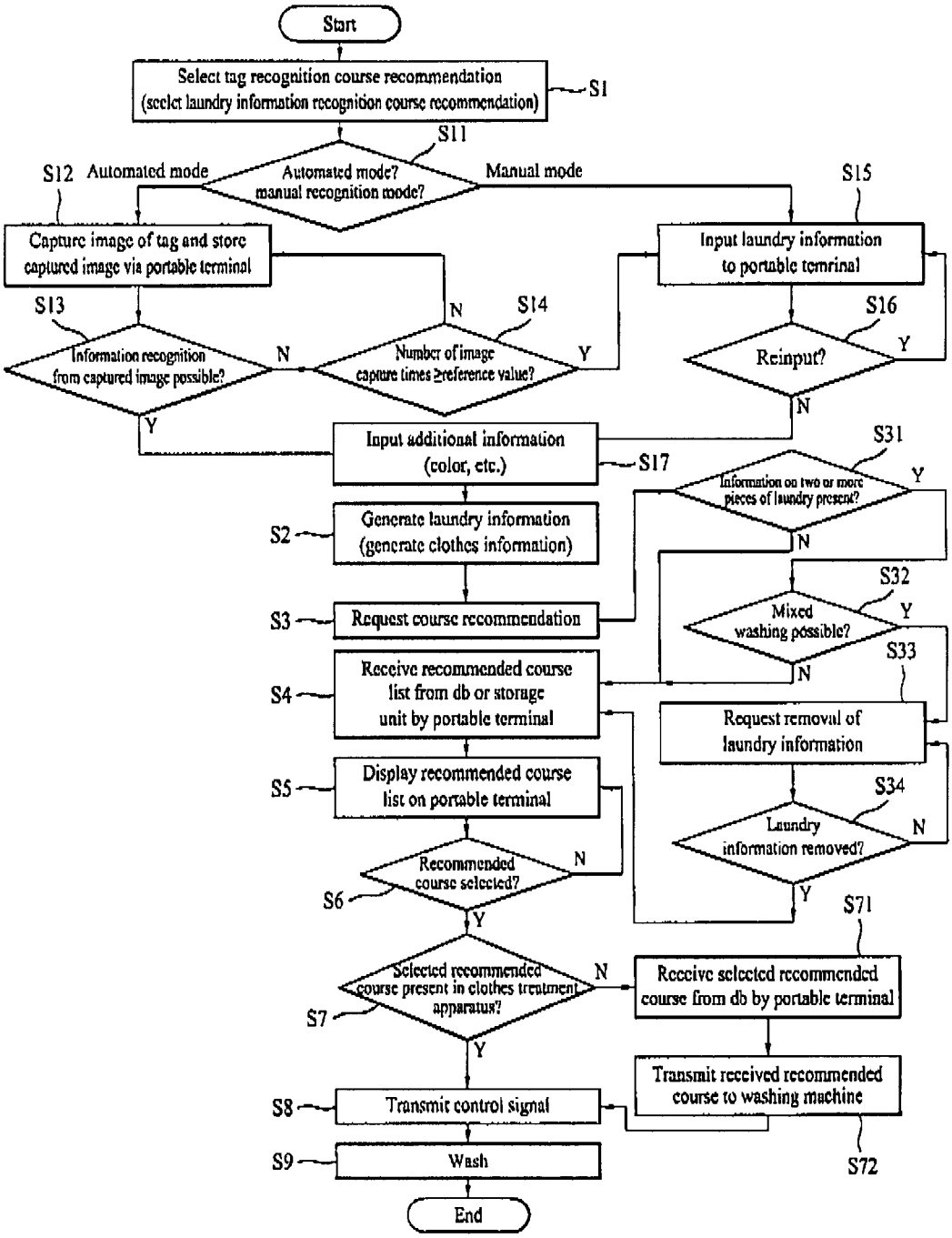
FIG. 11 is a view illustrating a control method according to the present invention.

Hereinafter, a control method of a system including the portable terminal 100, the clothes treatment apparatus 200, and the database 300 will be described with reference to FIG. 11.

In tag recognition course recommendation operation S1, the user pushes the tag recognition course recommendation area 11 from the main window 1 displayed on the display unit 110 of the portable terminal 100.

Once the tag recognition course recommendation operation S1 is executed, the control method of the present invention proceeds to mode recognition operation S11.

In the mode recognition operation S11, the user identifies whether a current mode is an automated mode in which clothes information is input via the clothes information input unit 120 such as the camera, or is a manual mode in which the user directly inputs clothes information via the input windows 27 and 28.

Once the automated mode is selected, the control method of the present invention proceeds to operation of storing an image of a laundry tag captured by the camera (S12), and operation of determining whether or not the controller 170 can recognize clothes information included in the captured image (S13).

If it is determined that the controller 170 can recognize clothes information from the captured image of the laundry tag, the control method of the present invention proceeds to operation of requesting input of additional information (S17).

On the other hand, if it is determined that the controller 170 cannot recognize clothes information from the captured image of the laundry tag, the control method of the present invention proceeds to operation of re-capturing an image of the laundry tag (S12). The laundry tag image re-capture operation S12 is performed only when the number of image capture times is less than a preset reference value.

That is, if the number of image capture times is equal to or greater than the preset reference value, the control method of the present invention proceeds to operation of requesting input of clothes information via the manual mode (S15).

The manual mode is a mode in which the user directly inputs clothes information printed on the laundry tag via the fiber blending radio input window 27 and the laundry care symbol input window 28 displayed on the display unit 110. The manual mode is initiated from the clothes information input operation S15.

Once the clothes information is input via the input windows 27 and 28, the display unit 110 inquires whether or not re-input of clothes information is necessary (S16). After input of the clothes information is completed, the control method of the present invention proceeds to additional information input operation (S17).

In the additional information input operation S17, the user inputs other information other than the fiber blending ratio of clothes and laundry care symbols via the additional information input window 23 displayed on the display unit 110. One example of the additional information input operation S17 may include input of color information of clothes.

After the additional information input operation S17 is completed, the control method of the present invention proceeds to operation of generating laundry information (S2).

In the laundry information generating operation S2, the clothes information generated via the above described operations is stored in the storage unit 160. The clothes information stored in the laundry information generating operation S2 may be identified via the basket display window 24 displayed on the display unit 100.

After the laundry information generating operation S2 is completed, the control method of the present invention proceeds to course recommendation request operation S3. The course recommendation request operation S3 begins as the user pushes the course recommendation request area 241 displayed in the basket display window 24.

If the user pushes the course recommendation request area 241, the controller 170 proceeds to operation of displaying, on the display unit 110, a suitable clothes treatment method for relevant clothes, which is selected from among various clothes treatment methods stored in the storage unit 160 based on the fiber blending ratio of clothes, a handling method of clothes and color information of clothes (S5).

It is to be noted that information on two or more pieces of laundry is generated via the laundry information generating operation S2 and suitable clothes treatment methods for the respective clothes may contradict one another. Therefore, the control method of the present invention may further include, after completion of the course recommendation request operation S3, inquiring whether or not information on two or more pieces of laundry is present (S31) and identifying whether or not mixed washing of two or more pieces of laundry is possible (S32).

If information on two or more pieces of laundry is not input in the laundry information generating operation S2 or information on two or more pieces of laundry that can allow mixed washing is input, the controller 170 receives a suitable clothes treatment method from the storage unit 160 or the database 300 (S4), and controls the display unit 110 to display the clothes treatment method (S5).

However, if information on two or more clothes that are unsuitable for mixed washing or mixed drying is input in the laundry information generating operation S2, the control method of the present invention proceeds to operation of displaying a message requesting removal of the corresponding laundry on the display unit 110 (S33).

If the user deletes information on clothes unsuitable for mixed washing or mixed drying from the storage unit 160 (S34), the control method of the present invention proceeds to operation of displaying clothes treatment methods on the display unit 110 (S5).

The operation S34 in which the user deletes information on clothes unsuitable for mixed washing or mixed drying from the storage unit 160 may be performed regardless of whether or not information on the clothes unsuitable for mixed washing or mixed drying is actually removed from the clothes treatment apparatus 200.

This is because even if it is notified via the portable terminal 100 that mixed washing or mixed drying of two or more pieces of laundry is unsuitable, the user may request recommendation of a clothes treatment method without separating relevant laundry from the clothes treatment apparatus 200 if the user judges that mixed washing or mixed drying of two or more pieces of laundry is not problematic.

If the display unit 110 displays a suitable clothes treatment method via the recommended course display window 25 (S5), the control method of the present invention proceeds to operation of identifying whether or not the user has selected the recommended clothes treatment method (S6).

If the user selects one clothes treatment method from the recommended course display window 25, the control method of the present invention proceeds to operation of identifying whether or not the clothes treatment apparatus 200 includes the clothes treatment method selected by the user.

If the clothes treatment method selected by the user is not included in the clothes treatment apparatus 200, the control method of the present invention may sequentially include downloading clothes treatment methods stored in the database 300 to the storage unit 160 (S71), and transmitting the downloaded clothes treatment methods (control data for the clothes treatment apparatus 200) to the clothes treatment apparatus 200 (S72).

In the case in which the clothes treatment method selected by the user is not included in the clothes treatment apparatus 200, alternatively, the control method of the present invention may include controlling the clothes treatment apparatus 200 and the database 300 such that the clothes treatment methods stored in the database 300 are directly downloaded to the clothes treatment apparatus 200.

If the clothes treatment method selected by the user is present in the clothes treatment apparatus 200, the control method of the present invention proceeds to operation of transmitting a control signal to actuate the clothes treatment apparatus 200 based on the received clothes treatment method (S8).

If the clothes treatment apparatus 200 receives the control signal from the portable terminal 100, the clothes treatment apparatus 200 performs washing or drying of clothes based on the transmitted clothes treatment method.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A portable terminal comprising:

a clothes information input unit, to which at least one of fiber blending ratio information of clothes and laundry care symbol information representing a handling method of clothes is input;

a display unit to display the information input via the clothes information input unit; a storage unit in which a plurality of clothes treatment methods is stored, the clothes treatment methods being classified based on the at least one of the fiber blending ratio information of clothes and information on the handling method of clothes;

a controller that selects at least one of the clothes treatment methods stored in the storage unit based on the information input via the clothes information input unit, and allows the selected clothes treatment method to be displayed on the display unit; and a terminal communications unit for data exchange with a clothes treatment apparatus, wherein the display unit includes a recommended course display area to display one or more clothes treatment methods selected by the controller, wherein the user is able to select any one of one or more clothes treatment methods displayed on the display unit via the recommended course display area, wherein the terminal communication unit transmits the clothes treatment method selected via the recommended course display area to the clothes treatment apparatus, and wherein the clothes treatment method transmitted to the clothes treatment apparatus via the terminal communication unit is data for control of at least one of rotating time, rotating direction and revolutions per minute of a drum that is provided in the clothes treatment apparatus for accommodation of clothes.

2. The portable terminal according to claim 1, wherein the clothes information input unit is a camera that inputs the at least one of fiber blending ratio information of clothes and laundry care symbol information by capturing an image of a laundry tag on which the at least one of the fiber blending ratio information of clothes and the laundry care symbol information is marked.

3. The portable terminal according to claim 2, wherein the display unit displays a guide area to display an image capture range of the laundry tag when capturing the image of the laundry tag via the camera.

4. The portable terminal according to claim 3, wherein the plurality of clothes treatment methods stored in the storage unit is set based on the fiber blending ratio of clothes, the handling method of clothes, and color information of clothes, and wherein the display unit displays an additional information input window for input of color information of clothes when the image of the laundry tag is completely captured via the camera.

5. The portable terminal according to claim 3, wherein the display unit displays a course recommendation request area to request the controller to display, on the display unit, the clothes treatment method based on information captured via the camera.

6. The portable terminal according to claim 5, wherein the storage unit stores a suitable clothes treatment method and an unsuitable clothes treatment method classified based on the fiber blending ratio of clothes and the handling method of clothes, and wherein the controller controls the display unit to display the suitable clothes treatment method and unsuitable clothes treatment method for relevant clothes based on the information captured via the camera.

7. The portable terminal according to claim 6, wherein the display unit displays both the suitable clothes treatment method and unsuitable clothes treatment method for relevant clothes at the same time.

8. The portable terminal according to claim 1, wherein the display unit displays a control signal transmission area to transmit the clothes treatment method selected via the recommended course display area to the clothes treatment apparatus.

9. The portable terminal according to claim 8, wherein a control signal to allow the clothes treatment apparatus to execute the received clothes treatment method is transmitted via the control signal transmission area.

10. The portable terminal according to claim 8, wherein, if the clothes treatment method transmitted to the clothes treatment apparatus via the control signal transmission area is a new clothes treatment method not stored in the clothes treatment apparatus, the display unit displays a new course guidance window to request that the clothes treatment apparatus receive the new clothes treatment method from a database that communicates with the clothes treatment apparatus or the storage unit.

11. The portable terminal according to claim 1, wherein the storage unit further stores at least one of the information input via the clothes information input unit, history information displayed as one category of multiple information input on the same date via the clothes information input unit, and item list information acquired by categorizing the history information on a per clothes name basis.

12. The portable terminal according to claim 11, further comprising an information request unit to allow the information stored in the storage unit to be displayed on the display unit, and wherein, if a request to display the information stored in the storage unit is input via the information request unit, the display unit displays a basket information request area to request display of the information input via the clothes information input unit, and a stored information request area to request display of at least one of the history information and the item list information.

13. A portable terminal comprising:

a display unit having a display area where at least one of fiber blending ratio information of clothes and laundry care symbol information representing a handling method of clothes is displayed, and an input unit to enable selection of the information displayed in the display area;

a storage unit in which a plurality of clothes treatment methods is stored, the clothes treatment methods being classified based on the at least one of the fiber blending ratio information of clothes and information on the handling method of clothes; and a controller that selects at least one of the clothes treatment methods stored in the storage unit based on the information input via the display unit, and allows the selected clothes treatment method to be displayed on the display unit, and a terminal communication unit for data exchange with a clothes treatment apparatus, wherein the display unit includes a recommended course display area to display one or more clothes treatment methods selected by the controller, wherein the user is able to select any one or more clothes treatment methods displayed on the display unit via the recommended course display area, wherein the terminal communication unit transmits the clothes treatment method selected via the recommended course display area to the clothes treatment apparatus, and wherein the clothes treatment method transmitted to the clothes treatment apparatus via the terminal communication unit is data for control of at least one of a rotating time, rotation direction and revolutions per minute of a drum that is provided in the clothes treatment apparatus for accommodation of clothes.

14. The portable terminal according to claim 13, further comprising a clothes information input unit, wherein the clothes information input unit is a camera that inputs the at least one of fiber blending ratio information of clothes and laundry care symbol information by capturing an image of a laundry tag on which the at least one of the fiber blending ratio information of clothes and the laundry care symbol information is marked, wherein the display unit displays a mode selection area to enable selection of any one of input of information via the clothes information input unit and input of information via the input area.

15. The portable terminal according to claim 14, wherein the plurality of clothes treatment methods stored in the storage unit is set based on the fiber blending ratio of clothes, the handling method of clothes, and color information of clothes, and wherein the display unit displays an additional information input window for input of color information of clothes when the at least one of the fiber blending ratio information of clothes and the laundry care symbol information is input via the input area or the clothes information input unit.

16. The portable terminal according to claim 14, wherein the display unit displays a course recommendation request area to request the controller to display, on the display unit, a clothes treatment method based on the information input via the input area or the clothes information input unit.

* * * * *